US006406577B1

(12) United States Patent
Benedict et al.

(10) Patent No.: US 6,406,577 B1
(45) **Date of Patent: *Jun. 18, 2002**

(54) METHOD OF MAKING ABRASIVE BELT WITH AN ENDLESS, SEAMLESS BACKING

(75) Inventors: Harold Wayne Benedict, Cottage Grove; Diana Denise Zimny, St. Paul; Donna Wendeln Bange, Eagan, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/733,706

(22) Filed: Oct. 17, 1996

Related U.S. Application Data

(63) Continuation of application No. 08/437,454, filed on May 8, 1995, now Pat. No. 5,609,706, which is a division of application No. 08/145,773, filed on Oct. 29, 1993, now Pat. No. 5,573,619, which is a division of application No. 07/919,541, filed on Jul. 24, 1992, now abandoned, which is a continuation-in-part of application No. 07/811,784, filed on Dec. 20, 1991, now abandoned.

(51) Int. Cl.[7] ..... B24D 11/02; B29C 53/66

(52) U.S. Cl. ..... 156/137; 156/140; 156/169; 156/173; 156/175; 451/532; 451/534; 451/536; 451/539

(58) Field of Search ..... 156/137, 140, 156/142, 173, 169, 175; 451/531, 536, 534, 532, 539, 297

(56) References Cited

U.S. PATENT DOCUMENTS

| | | | | |
|---|---|---|---|---|
| ,289,879 A | | 12/1883 | Almond | |
| 1,412,309 A | | 4/1922 | Lambert | |
| 1,676,845 A | | 7/1928 | Teisher | |
| 1,924,355 A | * | 8/1933 | Freedlander | 156/142 |
| 2,032,356 A | | 3/1936 | Ellis | |
| 2,209,074 A | | 7/1940 | Dahlstrom | |
| 2,333,035 A | | 10/1943 | Oglesby | |
| 2,349,365 A | | 5/1944 | Martin et al. | |
| 2,356,249 A | * | 8/1944 | Kremer et al. | 156/142 X |

(List continued on next page.)

FOREIGN PATENT DOCUMENTS

| | | |
|---|---|---|
| CA | 1023563 | 1/1978 |
| DE | 26 57 881 | 6/1978 |
| EP | 095055 | 11/1983 |

(List continued on next page.)

OTHER PUBLICATIONS

*The Nonwoven Handbook*; B.M. Lichstein., Ed.; Association of the Nonwoven Fabrics Industry: New York (1988)—Title page, copyright page, and table of contents only.

"Witcobound© W–290H, Wicobond W–293", Witco Corporation, Organics Division, Bulletin 345, 4 pgs (Apr. 1986).

"Product Information—Blendur P 120M", Mobay Corporation, 3 pgs (undated).

*Primary Examiner*—Jeff H. Aftergut
(74) *Attorney, Agent, or Firm*—Gregory D. Allen

(57) ABSTRACT

A coated abrasive backing consisting of an endless, seamless, loop is provided. The backing loop includes about 40–99% by weight of an organic polymeric binder, based upon the weight of the backing; and an effective amount of a fibrous reinforcing material engulfed within the organic polymeric binder material. The endless, seamless backing loop includes a length with parallel side edges, and at least one layer of fibrous reinforcing material engulfed within the organic polymeric binder material such that there are regions of organic binder material free of fibrous reinforcing material on opposite surfaces of the layer of fibrous reinforcing material. The fibrous reinforcing material can be in the form of individual fibrous strands, a fibrous mat structure, or a combination of the these. A method for preparing the endless, seamless backing loop for a coated abrasive belt is also provided. The method includes the steps of preparing a loop of liquid binder material having fibrous reinforcing material therein around the periphery of a drum; and solidifying the binder material such that an endless, seamless, backing loop having fibrous reinforcing material engulfed within the organic polymeric binder material is formed.

32 Claims, 5 Drawing Sheets

U.S. PATENT DOCUMENTS 2,356,866 A 8/1944 Melton et al.
2,391,731 A 12/1945 Miller et al.
2,404,207 A 7/1946 Ball
2,411,724 A 11/1946 Hill
2,468,853 A 5/1949 Williamson
2,590,697 A 3/1952 Grove
2,682,733 A 7/1954 Buckner
2,704,735 A 3/1955 Hedges et al.
2,712,987 A 7/1955 Storrs et al.
2,743,559 A 5/1956 Ball et al.
2,773,540 A * 12/1956 Waugh ..... 156/142 X
2,785,442 A 3/1957 Boggs
2,983,637 A 5/1961 Schmidt
2,995,176 A 8/1961 Waugh
2,999,780 A 9/1961 Perrault
3,030,743 A 4/1962 Raymond
RE25,587 E 6/1964 Wiltshire
3,166,388 A 1/1965 Riegger et al.
3,276,852 A 10/1966 Lemelson
3,333,372 A * 8/1967 Gianatasio ..... 451/531
3,561,938 A 2/1971 Block et al.
3,562,968 A 2/1971 Johnson et al.
3,577,872 A 5/1971 Drummond
3,607,502 A * 9/1971 Marzocchi et al. ..... 156/142
3,729,873 A 5/1973 Sandell
3,860,400 A 1/1975 Prowse et al.
3,900,355 A 8/1975 Goto et al.
4,018,574 A * 4/1977 Dyer ..... 451/531 X
4,049,767 A 9/1977 Vaidya
4,163,647 A 8/1979 Swiatek
4,215,516 A 8/1980 Huschle et al.
4,253,836 A 3/1981 Miranti, Jr.
4,256,467 A 3/1981 Gorsuch
4,282,011 A 8/1981 Terpay
4,289,168 A 9/1981 Lecourt et al.
4,314,827 A 2/1982 Leitheiser et al.
4,373,933 A 2/1983 Grazen
4,394,340 A 7/1983 Tarumi et al.
4,455,343 A 6/1984 Temple
4,525,177 A 6/1985 Grimes et al.
4,539,017 A 9/1985 Augustin
4,554,765 A 11/1985 Grimes et al.
4,588,419 A 5/1986 Caul et al.
4,609,581 A 9/1986 Ott et al.
4,652,274 A 3/1987 Boettcher et al.
4,652,275 A 3/1987 Bloecher et al.
4,653,236 A 3/1987 Grimes et al.
4,681,558 A * 7/1987 Rausch ..... 156/137 X
4,734,104 A 3/1988 Broberg
4,736,549 A 4/1988 Toillie
4,744,802 A 5/1988 Schwabel
4,770,671 A 9/1988 Monroe et al.
4,799,939 A 1/1989 Bloecher et al.
4,867,760 A 9/1989 Yarbrough
4,881,951 A 11/1989 Wood et al.
4,894,280 A 1/1990 Guthrie et al.
4,903,440 A 2/1990 Larson et al.
4,906,523 A 3/1990 Bilkadi et al.
4,960,442 A 10/1990 Wagner et al.
5,011,508 A 4/1991 Wald et al.
5,078,753 A 1/1992 Broberg et al.
5,108,462 A 4/1992 Habeeb et al.
5,108,463 A 4/1992 Buchanan
5,109,638 A 5/1992 Kime, Jr.
5,137,542 A 8/1992 Buchanan et al.
5,203,884 A 4/1993 Buchanan et al.
5,219,505 A 6/1993 Kaiser
5,236,472 A 8/1993 Kirk et al.
5,316,812 A 5/1994 Stout et al.
5,341,609 A 8/1994 Gorsuch et al.
5,344,688 A 9/1994 Peterson et al.
5,420,015 A 5/1995 Wuerch
5,436,063 A 7/1995 Follett et al.
5,573,619 A * 11/1996 Benedict et al. ..... 156/137

FOREIGN PATENT DOCUMENTS

EP 142140 5/1985
EP 213353 3/1987
EP 0 257 757 A3 3/1988
EP 321959 6/1989
EP 333909 9/1989
EP 340982 11/1989
EP 349466 1/1990
EP 451944 10/1991
EP 533482 3/1993
EP 626238 11/1994
FR 2095185 2/1972
FR 2250049 5/1975
FR 2396625 2/1979
GB 1240289 7/1971
GB 1475986 * 5/1974
GB 1445520 8/1976
GB 1492789 11/1977
GB 2 232 636 A 12/1990
GB 2240736 8/1991
JP 3-55170 3/1991
WO 8602306 * 4/1986
WO 93/02837 2/1993
WO 93/12911 7/1993
WO 93/24279 12/1993
WO 95/00294 1/1995
WO 95/11111 4/1995
WO 95/22434 8/1995
WO 95/22438 8/1995

OTHER PUBLICATIONS

Product Information from Air Products & Chemicals, Inc. regarding Durathane™, 1 pg (Jan. 3, 1994).
Shell, "Material Safety Data Sheet", 1 pg (Jun. 13, 1995).
Henkel Polymers Division, "Epoxy Curing Agents Product Data Sheet for Genamid 747", Identified as P–182 (undated) (2 pages).
"Material Safety Data Sheet—Polytetramethyleneoxide–di–p–aminobenzoate", Polaroid Corporation, No. RCC–209 R–2, 4 pgs (Jan. 1984).
*Me*, Nov. 1990 (2 pages).
"NeoRez and NeoPac Water–borne Urethanes for Coatings Applications", ICI Resins US, 3 pgs (undated).
"Standard Test Methods for Impact Resistance of Rigid Plastic Sheeting or Parts by Means of a TUP (Falling Weight)", ASTM Designation: D3029–84, 749–764 (Sep. 1984).
"Standard Test Methods for Flexural Properties of Unreinforced and Reinforced Plastics and Electrical Insulating Materials", ASTM Designation: D790–86, 384–397 (1986).
B. F. Goodrich Specialty Polymers & Chemicals Division, "Product Data HYCAR Reactive Liquid Polymers" Brochure dated Apr. 1991 (5 pages).
"Air Products Announces Trademark Changes for Polyurethane Prepolymers and Curatives", News Release #94034 from Air Products & Chemicals, Inc., 2 pgs (Jan. 3, 1994).
"American National Standard for Grading of Certain Abrasive Grain on Coated Abrasive Material", sponsored by Grinding Wheel Institute (ANSI Standard B74.18–1984), 32 pages (Jan. 27, 1984).
"Standard Test Methods for Impact Resistance of Plastics and Electrical Insulating Materials", ASTM Designation: D256–84, 81–102 (Sep. 1984).

* cited by examiner

FIG. 4
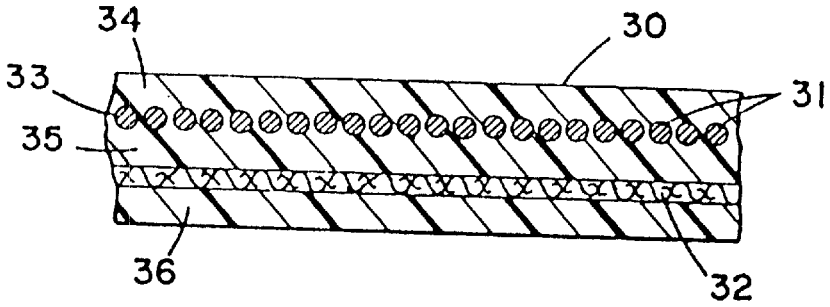
FIG. 5
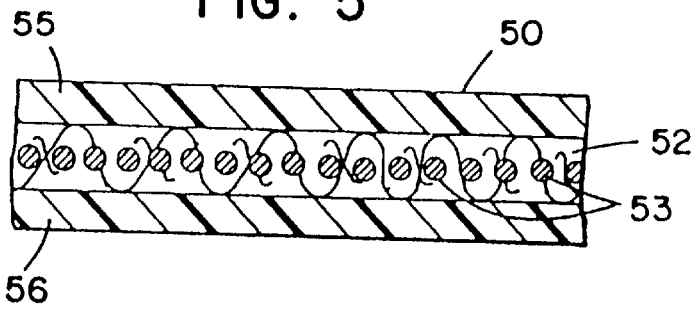
FIG. 6
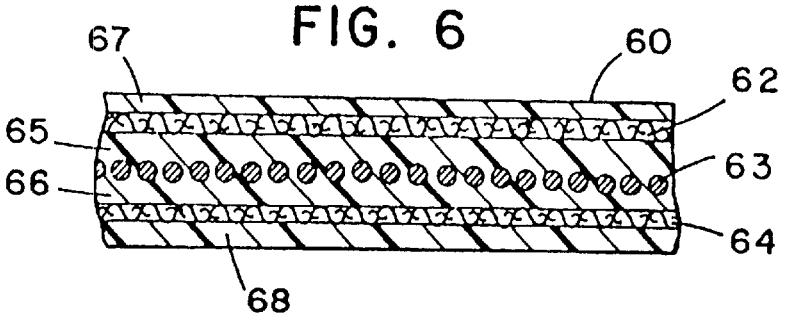
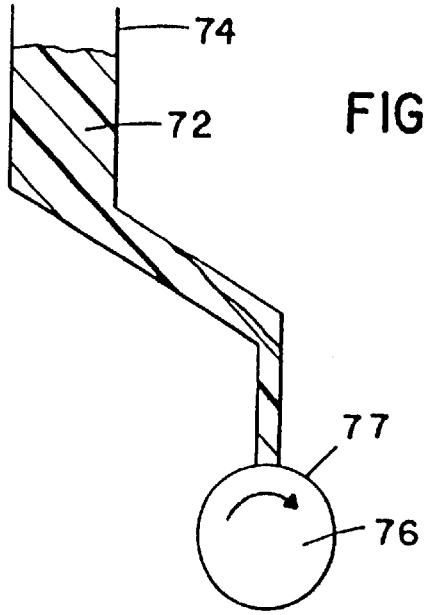
FIG. 7

METHOD OF MAKING ABRASIVE BELT WITH AN ENDLESS, SEAMLESS BACKING

This is a continuation of application Ser. No. 08/437,454, filed May 8, 1995, now U.S. Pat. No. 5,609,706, which is a division of application Ser. No. 08/145,773, filed Oct. 29, 1993, now U.S. Pat. No. 5,573,619, which in turn, was a division of application Ser. No. 07/919,541, filed Jul. 24, 1992 (now abandoned), which, in turn, was a continuation-in-part of application Ser. No. 07/811,784, filed Dec. 20, 1991 (now abandoned).

FIELD OF THE INVENTION

The present invention pertains to coated abrasive articles, and particularly to coated abrasive belts with endless, seamless backings containing an organic polymeric binder and a fibrous reinforcing material. Additionally, this invention pertains to methods of making endless, seamless backings for use in coated abrasive belts.

BACKGROUND ART

Coated abrasive articles generally contain an abrasive material, typically in the form of abrasive grains, bonded to a backing by means of one or more adhesive layers. Such articles usually take the form of sheets, discs, belts, bands, and the like, which can be adapted to be mounted on pulleys, wheels, or drums. Abrasive articles can be used for sanding, grinding, or polishing various surfaces of, for example, steel and other metals, wood, wood-like laminates, plastic, fiberglass, leather, or ceramics.

The backings used in coated abrasive articles are typically made of paper, polymeric materials, cloth, nonwoven materials, vulcanized fiber, or combinations of these materials. Many of these materials provide unacceptable backings for certain applications because they are not of sufficient strength, flexibility, or impact resistance. Some of these materials age unacceptably rapidly. Also, some are sensitive to liquids that are used as coolants and cutting fluids. As a result, early failure and poor functioning can occur in certain applications.

In a typical manufacturing process, a coated abrasive article is made in a continuous web form and then converted into a desired construction, such as a sheet, disc, belt, or the like. One of the most useful constructions of a coated abrasive article is an endless coated abrasive belt, i.e., a continuous loop of coated abrasive material. In order to form such an endless belt, the web form is typically cut into an elongate strip of a desired width and length. The ends of the elongate strip are then joined together to create a "joint" or a "splice."

Two types of splices are common in endless abrasive belts. These are the "lap" splice and the "butt" splice. For the lap splice, the ends of the elongate strip are bevelled such that the top surface with the abrasive coating and the bottom surface of the backing fit together without a significant change in the overall thickness of the belt. This is typically done by removing abrasive grains from the abrasive surface of the strip at one of the ends, and by removing part of the material from the backing of the elongate strip at the other end. The bevelled ends are then overlapped and joined adhesively.

For the butt splice, the bottom surface of the backing at each end of the elongate strip is coated with an adhesive and overlaid with a strong, thin, tear-resistant, splicing media. Although endless coated abrasive belts containing a splice in the backing are widely used in industry today, these products suffer from some disadvantages which can be attributed to the splice.

For example, the splice is generally thicker than the rest of the coated abrasive belt, even though the methods of splicing generally used involve attempts to minimize this variation in the thickness along the length of the belt. This can lead to a region(s) on the workpiece with a "coarser" surface finish than the remainder of the workpiece, which is highly undesirable especially in high precision grinding applications. For example, wood with areas having a coarser surface finish will stain darker than the remainder of the wood.

Also, the splice can be the weakest area or link in the coated abrasive belt. In some instances, the splice will break prematurely before full utilization of the coated abrasive belt. Belts have therefore often been made with laminated liners or backings to give added strength and support. Such belts can be relatively expensive and under certain conditions can be subject to separation of the laminated layers.

In addition, abrading machines that utilize a coated abrasive belt can have difficulty properly tracking and aligning the belt because of the splice. Further, the splice creates a discontinuity in the coated abrasive belt. Also, the splice area can be undesirably more stiff than the remainder of the belt. Finally, the splice in the belt backing adds considerable expense in the manufacturing process of coated abrasive belts.

SUMMARY OF THE INVENTION

The present invention is directed to coated abrasive articles, particularly to coated abrasive belts made from endless, seamless backing loops. By the phrase "endless, seamless" it is meant that the backings, i.e., backing loops, used in the belts are continuous in structure throughout their length. That is, they are free from any distinct splices or joints. This does not mean, however, that there are no internal splices in, for example, a fibrous reinforcing layer, or that there are no splices in an abrasive layer. Rather, it means that there are no splices or joints in the backing that result from joining the ends of an elongate strip of backing material.

Thus, the coated, abrasive articles of the invention do not exhibit many of the disadvantages associated with coated abrasive belts made from backing loops containing a splice. The coated abrasive belts of the invention can readily be prepared with substantially the same thickness or caliper along the entire length, i.e., circumference, of the belt. Typically, the thickness of the endless, seamless backing loops of the present invention does not vary by more than about 15% along the entire length of the loop and preferably varies less than 10%, more preferably less than 5% and most preferably less than 2%.

A coated abrasive belt of the present invention includes a backing in the form of an endless, seamless loop, which contains an organic polymeric binder material and a fibrous reinforcing material. Typically, the binder weight in the backing is within a range of about 40–99 wt-%, preferably within a range of about 50–95 wt-%, more preferably within a range of about 65–92 wt-%, and most preferably within a range of about 70–85 wt-%, based on the total weight of the backing. The polymeric binder material can be a thermosetting, thermoplastic, or elastomeric material or a combination thereof. Preferably it is a thermosetting or thermoplastic material. More preferably it is a thermosetting material. In some instances, the use of a combination of a thermosetting material and an elastomeric material is preferable.

The remainder of a typical, preferred, backing is primarily fibrous reinforcing material. Although there may be additional components added to the binder composition, a coated abrasive backing of the present invention primarily contains an organic polymeric binder and an effective amount of a fibrous reinforcing material. The phrase "effective amount" of fibrous reinforcing material refers to an amount sufficient to give the desired physical characteristics of the backing such as reduction in stretching or splitting during use.

The organic polymeric binder material and fibrous reinforcing material together comprise a flexible composition, i.e., flexible backing, in the form of an endless, seamless loop with generally parallel side edges.

The flexible, endless, seamless backing loop includes at least one layer of fibrous reinforcing material along the entire length of the belt. This layer of fibrous reinforcing material is preferably substantially completely surrounded by (i.e., engulfed within) the organic polymeric binder material. That is, the layer of fibrous reinforcing material is embedded or engulfed within the internal structure of the loop, i.e., within the body of the loop, such that there are regions of organic binder material free of fibrous reinforcing material on opposite surfaces of the layer of fibrous reinforcing material. In this way, the surfaces, e.g., the outer and inner surfaces, of the loop have a generally smooth, uniform surface topology.

The fibrous reinforcing material can be in the form of individual fibrous strands or a fibrous mat structure. The endless, seamless loops, i.e., backing loops, of the present invention preferably consist of various layers of individual fibrous reinforcing strands and/or fibrous mat structures incorporated within, i.e., engulfed within, an internal structure or body of the backing. Preferred belts contain, for example, a thermosetting binder, a layer of noninterlacing parallel and coplanar individual fibrous reinforcing strands, and a layer of a fibrous mat structure wherein the fibrous material within one layer does not interlock with the fibrous material within the other layer.

Certain preferred belts of the present invention also contain a preformed abrasive coated laminate. This preformed laminate typically comprise a sheet material, i.e., material in the form of a sheet, coated with abrasive grains. The preformed abrasive coated laminate can be laminated, i.e., attached, to the outer surface of the backing of the present invention using a variety of means, such as an adhesive or mechanical fastening means. This embodiment of the coated abrasive article of the present invention is advantageous at least because of the potential for removing the laminate once the abrasive material is exhausted and replacing it with another such laminate. In this way the backing of the present invention can be reused. The term "preformed" in this context is meant to indicate that the abrasive coated laminate is prepared as a self-supporting sheet coated with abrasive material and subsequently applied to the endless, seamless backing loops of the present invention. Such embodiments typically have a seam in this preformed coated abrasive laminate layer. The backing loop, however, does not contain a seam or joint. Furthermore, the backing loop is not made of preformed and precured layers adhesively laminated together.

The coated abrasive backings of the present invention are prepared by: preparing a loop of liquid organic binder material having fibrous reinforcing material therein, in extension around a periphery of a support structure, such as a drum; and solidifying the liquid organic binder material such that a flexible, solidified, endless, seamless backing loop having fibrous reinforcing material therein is formed. The flexible, solidified, endless, seamless backing loop formed has an outer and an inner surface. The step of preparing a loop of liquid organic binder material having fibrous reinforcing material therein preferably includes the steps of: applying a fibrous reinforcing mat structure around the periphery of a support structure, such as a drum; and winding one individual reinforcing strand around the periphery of the support structure, e.g., drum, in the form of a helix in longitudinal extension around the backing loop, i.e., along the length of the backing, in a layer that spans the width of the backing.

An alternative, and preferred method of preparing the endless, seamless loops of the present invention includes coating, i.e., impregnating, the fibrous, reinforcing mat structure with the liquid organic binder material prior to being applied around the periphery of the support structure. One method of impregnating the fibrous reinforcing material is to coat the fibers through an orifice with the binder material. If the organic binder material is a solid material, such as a thermoplastic material, the step of preparing a loop of liquid organic binder material having fibrous reinforcing material therein includes: applying a first layer of a solid organic binder material around the periphery of a support structure, preferably a drum; applying a layer of fibrous reinforcing material around the first layer of solid organic polymeric binder material on the support structure; applying a second layer of a solid organic polymeric binder material around the first layer of solid organic polymeric binder material and the layer of fibrous reinforcing material on the support structure to form a structure of a solid organic polymeric binder material having a layer of fibrous reinforcing material therein; and heating the solid organic polymeric binder material until it flows and generally forms a liquid organic polymeric binder material having fibrous reinforcing material therein. Herein, the term "liquid" refers to a material that is flowable or flowing, whereas the term "solid" or "solidified" refers to a material that does not. readily flow under ambient temperatures and pressures, and is meant to include a thixotropic gel.

The flexible backing compositions of the invention can be coated with adhesive and abrasive layers using any conventional manner. Typically, and preferably, this involves: applying a first adhesive layer to the outer surface of a solidified, endless, seamless, loop having fibrous reinforcing material therein; embedding an abrasive material into the first adhesive layer; and, at least partially solidifying the first adhesive layer. The abrasive material, preferably in the form of grains, can be applied electrostatically or by drop coating. In preferred applications, a second adhesive layer is applied over the abrasive material and first adhesive layer; and both the first and second adhesive layers are fully solidified.

Alternatively, the first adhesive layer and the abrasive layer can be applied in one step by applying an abrasive slurry to the outer surface of the backing. The abrasive slurry includes an adhesive resin and an abrasive material, preferably a plurality of abrasive grains. The adhesive resin is then preferably at least partially solidified. A second adhesive layer can then be applied. In certain preferred applications of the present invention, a third adhesive layer can be applied if desired.

Similar methods can also be used in preparing a coated abrasive backing using a support structure, such as a conveyor system. Such a system would typically use, for example, a stainless steel sleeve, in the form of a conveyor belt. In this embodiment, the step of preparing a loop of liquid organic binder material includes preparing the loop around the conveyor belt.

BRIEF DESCRIPTION OF THE DRAWINGS

FIG. 1 being schematic in nature to reflect construction according to the present invention.

FIG. 3 being schematic in nature to reflect construction according to the present invention.

FIG. 4 is an enlarged fragmentary cross-sectional view of an endless, seamless backing loop according to the present invention taken generally along line 4—4, FIG. 3. The figure is schematic in nature to reflect a construction of the internal fibrous network in an endless, seamless, backing loop of this invention.

FIG. 5 is an enlarged fragmentary cross-sectional view of an endless, seamless backing loop according to the present invention taken generally analogously along line 4—4, FIG. 3. The figure is schematic in nature to reflect an alternative construction of the internal fibrous network in an endless, seamless, backing loop of this invention.

FIG. 6 is an enlarged fragmentary cross-sectional view of an endless, seamless backing loop according to the present invention taken generally analogously along line 4—4, FIG. 3. The figure is schematic in nature to reflect an alternative construction of the internal fibrous network in an endless, seamless, backing loop of this invention.

FIG. 7 is a side view of an apparatus for applying the binder to a drum.

DESCRIPTION OF THE PREFERRED EMBODIMENTS

Figure 1:
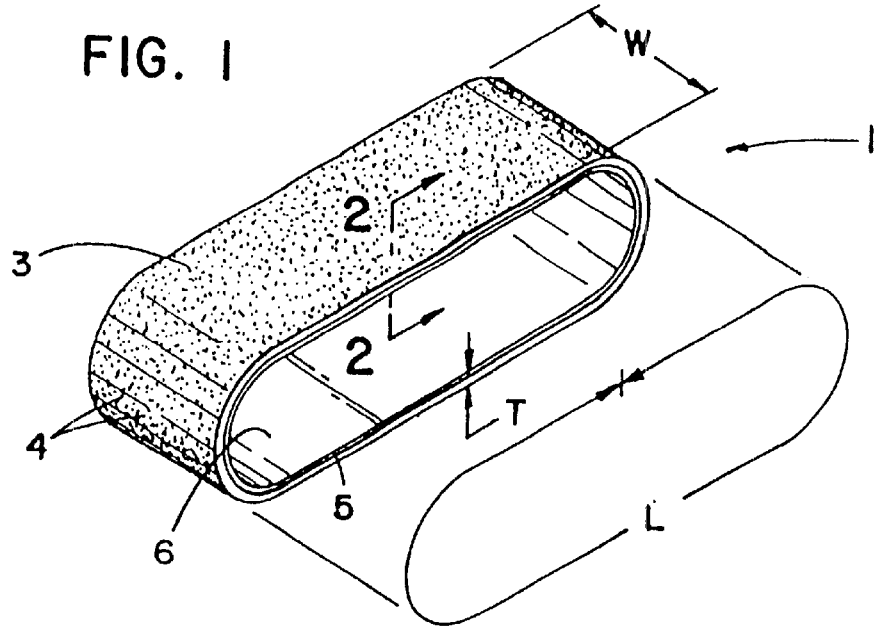
FIG. 1 is a perspective view of a coated abrasive belt formed from an endless, seamless, backing loop according to the invention.
Figure 2:
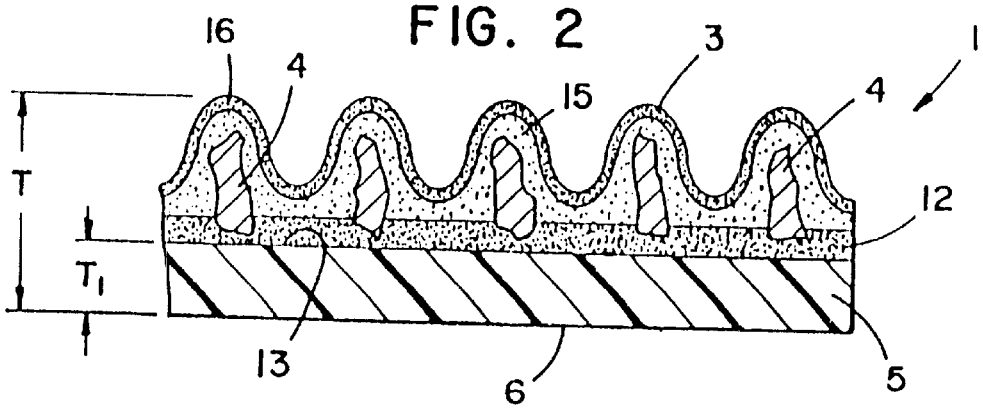
FIG. 2 is an enlarged fragmentary cross-sectional view of a coated abrasive belt according to the present invention taken generally along line 2—2, FIG. 1.

Referring to FIG. 1, a coated abrasive belt 1, according to the present invention, is shown which incorporates the construction of FIG. 2. Working surface i.e., the outer surface, of the belt 1 includes abrasive material in the form of abrasive grains 4 adhered to an endless, seamless backing loop 5 of the coated abrasive belt 1. The inner surface 6, i.e., the surface opposite that coated with the abrasive material is generally smooth. By "smooth" it is meant that there is generally no protruding fibrous reinforcing material.

Referring to FIG. 2, in general, a coated abrasive belt 1 (FIG. 1) includes: a backing 5; and a first adhesive layer 12, commonly referred to as the make coat, applied to a surface 13 of the backing 5. Herein, "coated abrasive" refers to an article with the abrasive material coated on the outer surface of the article. It is typically not meant to include articles wherein the abrasive grain is included within the backing. The purpose of the first adhesive layer 12 is to secure an abrasive material, preferably in the form of a plurality of abrasive grains 4, to the surface 13 of the backing 5. Referring to FIG. 2, a second adhesive layer 15, commonly referred to as a size coat, is coated over the abrasive grains 4 and first adhesive layer 12. The purpose of the second adhesive layer 15 is to reinforce the securement of abrasive grains 4. A third adhesive layer 16, commonly referred to as a supersize coat, is applied over the second adhesive layer 15. The supersize coat may be a release coating that prevents the coated abrasive from loading. "Loading" is the term used to describe the filling of spaces between abrasive particles with swarf (the material abraded from the workpiece) and the subsequent build-up of that material. Examples of loading resistant materials include metal salts of fatty acids, urea-formaldehyde, waxes, mineral oils, cross-linked silanes, cross-linked silicones, fluorochemicals and combinations thereof. A preferred material is zinc stearate. The third adhesive layer 16 is optional and is typically utilized in coated abrasive articles that abrade generally hard surfaces, such as stainless steel or exotic metal workpieces.

Referring again to FIG. 1, the coated abrasive belt 1 can generally be of any size desired for a particular application. The length "L", width "W", and thickness "T", can be of a variety of dimensions desired depending on the end use. Although the thickness "T" is shown in FIG. 1 with respect to a construction of a coated abrasive belt 1, the thickness "$T_1$" referred to herein, refers to the thickness of the endless, seamless backing loop 5, FIG. 2.

The length "L" of the-coated abrasive belt 1 can be any desired length. Typically it is about 40–1500 centimeters (cm). The thickness "$T_1$" of the endless, seamless backing loop 5 is typically between about 0.07 millimeter (mm) and about 1.5 mm for optimum flexibility, strength, and material conservation. Preferably, the thickness of the endless, seamless backing 5 is between about 0.1 and about 1.0 millimeter, and more preferably between about 0.2 and about 0.8 millimeter for coated abrasive applications. The thickness "$T_1$" of the endless, seamless backing loop 5 of coated abrasive belt 1 does not generally vary by more than about 15% around the entire length "L" of the belt 1, FIG. 1. Preferably, the thickness "$T_1$" throughout the entire endless, seamless backing loop 5 does not vary by more than about 10%, more preferably by no more than about 5% and most preferably by no more than 2%. Although this variance refers to a variance along the thickness "$T_1$" of the backing 5, this variance also generally applies to a backing coated with adhesives and abrasive material, i.e., the thickness "T" of the belt 1.

Backing

The preferred coated abrasive articles of the present invention generally include a backing with the following properties. The backing is sufficiently heat resistant under grinding conditions for which the abrasive article is intended to be used such that the backing does not significantly disintegrate, i.e., split, break, delaminate, tear, or a combination of these, as a result of the heat generated during a grinding, sanding, or polishing operation. The backing is also sufficiently tough such that it will not significantly crack or shatter from the forces encountered under grinding conditions for which the abrasive article is intended to be used. That is, it is sufficiently stiff to withstand typical grinding conditions encountered by coated abrasive belts, but not undesirably brittle.

Preferred backings of the present invention are sufficiently flexible to withstand grinding conditions. By "sufficient flexibility" and variants thereof in this context, it is meant that the backings will bend and return to their original shape without significant permanent deformation. For example, a continuous "flexible" backing loop is one that is sufficiently flexible to be used on a two (or more) roller mount or a two (or more) pulley mount in a grinder. Furthermore, for preferred grinding applications, the backing is capable of flexing and adapting to the contour of the workpiece being abraded, yet is sufficiently strong to transmit an effective grinding force when pressed against the workpiece.

Preferred backings of the present invention possess a generally uniform tensile strength in the longitudinal, i.e., machine direction. This is typically because the reinforcing material extends along the entire length of the backing and because there is no seam. More preferably, the tensile strength for any portion of a backing loop tested does not vary by more than about 20% from that of any other portion of the backing loop. Tensile strength is generally a measure of the maximum stress a material subjected to a stretching load can withstand without tearing.

Preferred backings of the present invention also exhibit appropriate shape control and are sufficiently insensitive to environmental conditions, such as humidity and temperature. By this it is meant that preferred coated abrasive backings of the present invention possess the above-listed properties under a wide range of environmental conditions. Preferably, the backings possess the above-listed properties within a temperature range of about 10–30° C., and a humidity range of about 30–50% relative humidity (RH). More preferably, the backings possess the above-listed properties under a wide range of temperatures, i.e., from below 0° C. to above 100° C., and a wide range of humidity values, from below 10% RH to above 90% RH.

Under extreme conditions of humidity, i.e., conditions of high humidity (greater than about 90%) and low humidity (less than about 10%), the backing of the present invention will not be significantly effected by either expansion or shrinkage due, respectively, to water absorption or loss. As a result, a coated abrasive belt made with a backing of the present invention will not significantly cup or curl in either a concave or a convex fashion.

The preferred backing material used in coated abrasive belts of the present invention is generally chosen such that there will be compatibility with, and good adhesion to, the adhesive layers, particularly to the make coat. Good adhesion is determined by the amount of "shelling" of the abrasive material. Shelling is a term used in the abrasive industry to describe the undesired, premature, release of a significant amount of the abrasive material from the backing. Although the choice of backing material is important, the amount of shelling typically depends to a greater extent on the choice of adhesive and the compatibility of the backing and adhesive layers.

In applications of the present invention, the organic polymeric binder material is present in a sufficient amount to fully surround the fibrous reinforcing material that is present in at least one generally distinct layer across the width, and along the entire length, of the backing loop. In this way, there is generally no fibrous reinforcing material exposed, i.e., there are regions of organic polymeric binder material generally without fibrous reinforcing material therein above and below the layer of reinforcing material. In preferred applications of the present invention, the binder is present in a sufficient amount to generally seal the surfaces of the backing, although the backing may have some porosity between the sealed surfaces as long as the tensile strength and other mechanical properties are not deleteriously effected.

Typically, the amount of organic polymeric binder material in the backing is within a range of about 40–99 wt-%, preferably within a range of about 50–95 wt-%, more preferably within a range of about 65–92 wt-%, and most preferably within a range of about 70–85 wt-%, of the total weight of the backing.

Backing Binder

The backing of the abrasive articles of the present invention contains a binder material and a fibrous reinforcing material. The binder material in the backing is an organic polymeric binder material. It can be a cured or solidified thermosetting resin, thermoplastic material, or elastomeric material. Preferably, the organic polymeric binder material is a cured or solidified thermosetting resin or thermoplastic material. More preferably, the organic polymeric binder material is a thermosetting resin, at least because such resins can be provided in a very fluid (low viscosity) flowable form when uncured, even under ambient conditions. Herein, the phrase "ambient conditions" and variants thereof refer to room temperature, i.e., 15–30° C., generally about 20–25° C., and 30–50% relative humidity, generally about 35–45% relative humidity.

If the organic polymeric binder material of the backing includes a cured thermosetting resin, prior to the manufacture of the backing, the thermosetting resin is in a nonpolymerized state, typically in a liquid or semi-liquid or gel state.

Examples of thermosetting resins from which the backing can be prepared include phenolic resins, amino resins, polyester resins, aminoplast resins, urethane resins, melamine-formaldehyde resins, epoxy resins, acrylated isocyanurate resins, urea-formaldehyde resins, isocyanurate resins, acrylated urethane resins, acrylated epoxy resins or mixtures thereof. The preferred thermo-setting resins are epoxy resins, urethane resins, polyester resins, or flexible phenolic resins. The most preferred resins are epoxy resins and urethane resins, at least because they exhibit an acceptable cure rate, flexibility, good thermal stability, strength, and water resistance. Furthermore, in the uncured state, typical epoxy resins have low viscosity, even at high percent solids. Also, there are many suitable urethanes available at high percent solids.

Phenolic resins are usually categorized as resole or novolac phenolic resins. Examples of useful commercially available phenolic resins are "Varcum" from BTL Specialty Resins Corporation, Blue Island, Ill.; "Arofene" from Ashland Chemical Company, Columbus, Ohio; "Bakelite" from Union Carbide, Danbury, Conn.; and "Resinox" from Monsanto Chemical Company, St. Louis, Mo.

Resole phenolic resins are characterized by being alkaline catalyzed and having a molar ratio of formaldehyde to phenol of greater than or equal to 1:1. Typically, the ratio of formaldehyde to phenol is within a range of about 1:1 to about 3:1. Examples of alkaline catalysts useable to prepare resole phenolic resins include sodium hydroxide, potassium hydroxide, organic amines, or sodium carbonate.

Novolac phenolic resins are characterized by being acid catalyzed and having a molar ratio of formaldehyde to phenol of less than 1:1. Typically, the ratio of formaldehyde to phenol is within a range of about 0.4:1 to about 0.9:1. Examples of the acid catalysts used to prepare novolac phenolic resins include sulfuric, hydrochloric, phosphoric, oxalic, or p-toluenesulfonic acids. Although novolac phenolic resins are typically considered to be thermoplastic resins rather than thermosetting resins, they can react with other chemicals (e.g., hexamethylenetetraamine) to form a cured thermosetting resin.

Epoxy resins useful in the polymerizable mixture used to prepare the hardened backings of this invention include monomeric or polymeric epoxides. Useful epoxy materials, i.e., epoxides, can vary greatly in the nature of their backbones and substituent groups. Representative examples of acceptable substituent groups include halogens, ester groups, ether groups, sulfonate groups, siloxane groups, nitro groups, or phosphate groups. The weight average molecular weight of the epoxy-containing polymeric materials can vary from about 60 to about 4000, and are preferably within a range of about 100 to about 600. Mixtures of various epoxy-containing materials can be used in the compositions of this invention. Examples of commercially available epoxy resins include "Epon" from Shell Chemical, Houston, Tex.; and "DER" from Dow Chemical Company, Midland, Mich.

Examples of commercially available urea-formaldehyde resins include "Uformite" from Reichhold Chemical, Inc., Durham, N.C.; "Durite" from Borden Chemical Co., Columbus, Ohio; and "Resimene" from Monsanto, St. Louis, Mo. Examples of commercially available melamine-formaldehyde resins include "Uformite" from Reichhold Chemical, Inc., Durham, N.C.; and "Resimene" from Monsanto, St. Louis, Mo. "Resimene" is used to refer to both urea-formaldehyde and melamine-formaldehyde resins.

Examples of aminoplast resins useful in applications according to the present invention are those having at least 1.1 pendant$\alpha,\beta$-unsaturated carbonyl groups per molecule, which are disclosed in U.S. Pat. No. 4,903,440, incorporated herein by reference.

Useable acrylated isocyanurate resins are those prepared from a mixture of: at least one monomer selected from the group consisting of isocyanurate derivatives having at least one terminal or pendant acrylate group and isocyanate derivatives having at least one terminal or pendant acrylate group; and at least one aliphatic or cycloaliphatic monomer having at least one terminal or pendant acrylate group. These atcrylated isocyanurate resins are described in U.S. Pat. No. 4,652,274, which is incorporated herein by reference.

Acrylated urethanes are diacrylate esters of hydroxy terminated —NCO— extended polyesters or polyethers. Examples of commercially available acrylated urethanes useful in applications of the present invention include those having the trade names "Uvithane 782," available from Morton Thiokol Chemical, Chicago, Ill., "Ebecryl 6600," "Ebecryl 8400," and "Ebecryl 88-5," available from Radcure Specialties, Atlanta, Ga.

The acrylated epoxies are diacrylate esters, such as the diacrylate esters of bisphenol A epoxy resin. Examples of commercially available acrylated epoxies include those having the trade names "Ebecryl 3500," "Ebecryl 3600," and "Ebecryl 8805," available from Radcure Specialties, Atlanta, Ga.

Suitable thermosetting polyester resins are available as "E-737" or "E-650" from Owens-Corning Fiberglass Corp., Toledo, Ohio. Suitable polyurethanes are available as "Vibrathane B-813 prepolymer" or "Adiprene BL-16 prepolymer" used with "Caytur-31" curative. All are available from Uniroyal Chemical, Middlebury, Conn.

As indicated previously, in some applications of the present invention, a thermoplastic binder material can be used, as opposed to the preferred thermosetting resins discussed above. A thermoplastic binder material is a polymeric material that softens when exposed to elevated temperatures and generally returns to its original physical state when cooled to ambient temperatures. During the manufacturing process, the thermoplastic binder is heated above its softening temperature, and often above its melting temperature, to form the desired shape of the coated abrasive backing. After the backing is formed, the thermoplastic binder is cooled and solidified. Thus, with a thermoplastic material, injection molding can be used to advantage.

Preferred thermoplastic materials of the invention are those having a high melting temperature and/or good heat resistant properties. That is, preferred thermoplastic materials have a melting point of at least about 100° C., preferably at least about 150° C. Additionally, the melting point of the preferred thermoplastic materials is sufficiently lower, i.e., at least about 25° C. lower, than the melting temperature of the reinforcing material.

Examples of thermoplastic materials suitable for preparations of backings in articles according to the present invention include polycarbonates, polyetherimides, polyesters, polysulfones, polystyrenes, acrylonitrile-butadiene-styrene block copolymers, polypropylenes, acetal polymers, polyamides, polyvinyl chlorides, polyethylenes, polyurethanes, or combinations thereof. Of this list, polyamides, polyurethanes, and polyvinyl chlorides are preferred, with polyurethanes and polyvinyl chlorides being most preferred.

If the thermoplastic material from which the backing is formed is a polycarbonate, polyetherimide, polyester, polysulfone, or polystyrene material, a primer can be used to enhance the adhesion between the backing and the make coat. The term "primer" is meant to include both mechanical and chemical type primers or priming processes. This is not meant to include a layer of cloth or fabric attached to the surface of the backing. Examples of mechanical primers include, but are not limited to, corona treatment and scuffing, both of which increase the surface area of the surface. An example of a preferred chemical primer is a colloidal dispersion of, for example, polyurethane, acetone, a colloidal oxide of silicon, isopropanol, and water, as taught by U.S. Pat. No. 4,906,523, which is incorporated herein by reference.

A third type of binder useful in the backings of the present invention is an elastomeric material. An elastomeric material, i.e., elastomer, is defined as a material that can be stretched to at least twice its original length and then retract very rapidly to approximately its original length, when released. Examples of elastomeric materials useful in applications of the present invention include styrene-butadiene copolymers, polychloroprene (neoprene), nitrile rubber, butyl rubber, polysulfide rubber, cis-1,4-polyisoprene, ethylene-propylene terpolymers, silicone rubber, or polyurethane rubber. In some instances, the elastomeric materials can be cross-linked with sulfur, peroxides, or similar curing agents to form cured thermosetting resins.

Reinforcing Material

Besides the organic polymeric binder material, the backing of the present invention includes an effective amount of a fibrous reinforcing material. Herein, an "effective amount" of a fibrous reinforcing material is a sufficient amount to impart at least improvement in desirable characteristics to the backing as discussed above, but not so much as to give rise to any significant number of voids and detrimentally effect the structural integrity of the backing. Typically, the amount of the fibrous reinforcing material in the backing is within a range of about 1–60 wt-%, preferably 5–50 wt-%, more preferably 8–35 wt-%, and most preferably 15–30 wt-%, based on the total weight of the backing.

The fibrous reinforcing material can be in the form of fibrous strands, a fiber mat or web, or a switchbonded or weft insertion mat. Fibrous strands are commercially available as threads, cords, yarns, rovings, and filaments. Threads and cords are typically assemblages of yarns. A thread has a very high degree of twist with a low friction surface. A cord can be assembled by braiding or twisting yarns and is generally larger than a thread. A yarn is a plurality of fibers or filaments either twisted together or entangled. A roving is a plurality of fibers or filaments pulled together either without a twist or with minimal twist. A filament is a continuous fiber. Both rovings and yarns are composed of individual filaments. A fiber mat or web consists of a matrix of fibers, i.e., fine threadlike pieces with an aspect ratio of at least about 100:1. The aspect ratio of a fiber is the ratio of the longer dimension of the fiber to the shorter dimension.

The fibrous reinforcing material can be composed of any material that increases the strength of the backing. Examples of useful reinforcing fibrous material in applications of the present invention include metallic or nonmetallic fibrous material. The preferred fibrous material is nonmetallic. The nonmetallic fibrous materials may be materials made of glass, carbon, minerals, synthetic or natural heat resistant organic materials, or ceramic materials. Preferred fibrous reinforcing materials for applications of the present invention are organic materials, glass, and ceramic fibrous material.

By "heat resistant" organic fibrous material, it is meant that useable organic materials should be sufficiently resistant to melting, or otherwise softening or breaking down, under the conditions of manufacture and use of the coated abrasive backings of the present invention. Useful natural organic fibrous materials include wool, silk, cotton, or cellulose. Examples of useful synthetic organic fibrous materials are made from polyvinyl alcohol, nylon, polyester, rayon, polyamide, acrylic, polyolefin, aramid, or phenol. The preferred organic fibrous material for applications of the present invention is aramid fibrous material. Such a material is commercially available from the Dupont Co., Wilmington, Del. under the trade names of "Kevlar" and "Nomex."

Generally, any ceramic fibrous reinforcing material is useful in applications of the present invention. An example of a ceramic fibrous reinforcing material suitable for the present invention is "Nextel" which is commercially available from 3M Co., St. Paul, Minn.

Examples of useful, commercially available, glass fibrous reinforcing material in yarn or roving form are those available from PPG Industries, Inc. Pittsburgh, Pa., under the product name E-glass bobbin yarn; Owens Corning, Toledo, Ohio, under the product name "Fiberglass" continuous filament yarn; and Manville Corporation, Toledo, Ohio, under the product name "Star Rov 502" fiberglass roving. The size of glass fiber yarns and rovings are typically expressed in units of yards/lb. Useful grades of such yarns and rovings are in the range of 75 to 15,000 yards/lb, which are also preferred.

If glass fibrous reinforcing material is used, it is preferred that the glass fibrous material be accompanied by an interfacial binding agent, i.e., a coupling agent, such as a silane coupling agent, to improve adhesion to the organic binder material, particularly if a thermoplastic binder material is used. Examples of silane coupling agents include Dow-Corning "Z-6020" or Dow Corning "Z-6040," both available from Dow-Corning Corp., Midland, Mich.

Advantages can be obtained through use of fibrous reinforcing materials of a length as short as 100 micrometers, or as long as needed for a fibrous reinforcing layer formed from one continuous strand. It is preferred that the fibrous reinforcing material used be in the form of essentially one continuous strand per layer of reinforcing material. That is, it is preferred that the fibrous reinforcing material is of a length sufficient to extend around the length, i.e., circumference, of the coated abrasive loop a plurality of times and provide at least one distinct layer of fibrous reinforcing material.

The reinforcing fiber denier, i.e., degree of fineness, for preferred fibrous reinforcing material ranges from about 5 to about 5000 denier, typically between about 50 and about 2000 denier. More preferably, the fiber denier will be between about 200 and about 1200, and most preferably between about 500 and about 1000. It is understood that the denier is strongly influenced by the particular type of fibrous reinforcing material employed.

The fibrous reinforcing material can be in the form of fibrous strands, a fiber mat or web, or a switchbonded or weft insertion mat. A primary purpose of a mat or web structure is to increase the tear resistance of the coated abrasive backing. The mat or web can be either in a woven or a nonwoven form. Preferably, the mat consists of nonwoven fibrous material at least because of its openness, nondirectional strength characteristics, and low cost.

A nonwoven mat is a matrix of a random distribution of fibers. This matrix is usually formed by bonding fibers together either autogeneously or by an adhesive. That is, a nonwoven mat is generally described as a sheet or web structure made by bonding or entangling fibers or filaments by mechanical, thermal, or chemical means.

Examples of nonwoven forms suitable for this invention include staple bonded, spun bonded, melt blown, needle punched, or thermo-bonded forms. A nonwoven web is typically porous, having a porosity of about 15% or more. Depending upon the particular nonwoven employed, the fiber length can range from about 100 micrometers to infinity, i.e., continuous fibrous strands. Nonwoven mats or webs are further described in "The Nonwovens Handbook" edited by Bernard M. Lichstein, published by the Association of the Nonwoven Fabrics Industry, New York, 1988.

The thickness of the fibrous mat structure when applied in typical applications of the present invention generally ranges from about 25 to about 800 micrometers, preferably from about 100 to about 375 micrometers. The weight of a preferred fibrous mat structure generally ranges from about 7 to about 150 grams/square meter ($g/m^2$), preferably from about 17 to about 70 $g/m^2$. In certain preferred applications of the present invention, the backing contains only one layer of the fibrous mat structure. In other preferred embodiments it can contain multiple distinct layers of the fibrous mat structure distributed throughout the binder. Preferably, there are 1 to 10 layers, and more preferably 2 to 5 layers, of the fibrous mat structure in backings of the present invention. Preferably about 1–50 wt %, and more preferably about 5–20 wt %, of the preferred backings of the present invention is the fibrous reinforcing mat.

The type of fibrous reinforcement chosen typically depends on the organic polymeric binder material chosen and the use of the finished product. For example, if a thermoplastic binder material is desired, reinforcement strands are important for imparting strength in the longitudinal direction. The binder material itself generally has good cross-belt strength and flexibility, i.e., in the direction of the width of the belt. If a thermosetting binder material is desired, a fibrous mat structure is important for imparting strength and tear resistance.

The endless, seamless backing loops of the present invention preferably and advantageously include a combination of fibrous reinforcing strands and a fibrous mat structure. The fibrous strands can be individual strands embedded within the fibrous mat structure for advantage, at least with respect to manufacturing ease. The fibrous strands can also form distinct layer(s) separate from, i.e., noninterlocking or intertwining with, the fibrous mat structure.

The fibrous mat structure is advantageous at least because it generally increases the tear resistance of the endless, seamless loops of the present invention. For endless, seamless loops that include both fibrous reinforcing strands and a fibrous mat structure, the fibrous mat structure is preferably about 1–50 wt %, more preferably about 5–20 wt %, of the backing composition, and the fibrous reinforcing strands are preferably about 5–50 wt %, more preferably about 7–25 wt %, of the backing composition.

As stated above, the fibrous reinforcing material can also be in the form of a mat structure containing adhesive or melt-bondable fibers used to integrate-parallel strands of individual fibers. In this way, "individual" parallel strands are embedded, i.e., incorporated, within a fibrous reinforcing mat. These parallel strands can be in direct contact with each other along their length, or they can be separated from each other by a distinct distance. Thus, the advantages of using individual fibrous reinforcing strands can be incorporated into a mat structure. Such melt-bondable fibers are disclosed in European Patent Application 340,982, published Nov. 8, 1989, which is incorporated herein by reference.

The fibrous reinforcing material can be oriented as desired for advantageous applications of the present invention. That is, the fibrous reinforcing material can be randomly distributed, or the fibers and/or strands can be oriented to extend along a direction desired for imparting improved strength and tear characteristics.

As stated previously, in certain applications of the present invention, individual reinforcing strands can be adjacent to one another within a layer of fibrous reinforcing material without overlapping or crossing or the reinforcing strands may be interlacing. They can also be in the form of a plurality of noninterlacing parallel and coplanar reinforcing strands. Furthermore, there can be a plurality of layers, i.e., planes, of fibrous reinforcing material, which can be oriented parallel or perpendicular to one another.

The fibrous reinforcing material can be directed such that the majority of the strength in the cross direction can be attributed to the organic polymeric binder. To achieve this, either a high weight ratio of binder to fibrous reinforcing material is employed, such as about 10:1; or, the fibrous reinforcing material, usually in the form of individual reinforcing strands, is present in only the machine, i.e., longitudinal, direction of the backing loop.

Figure 3:
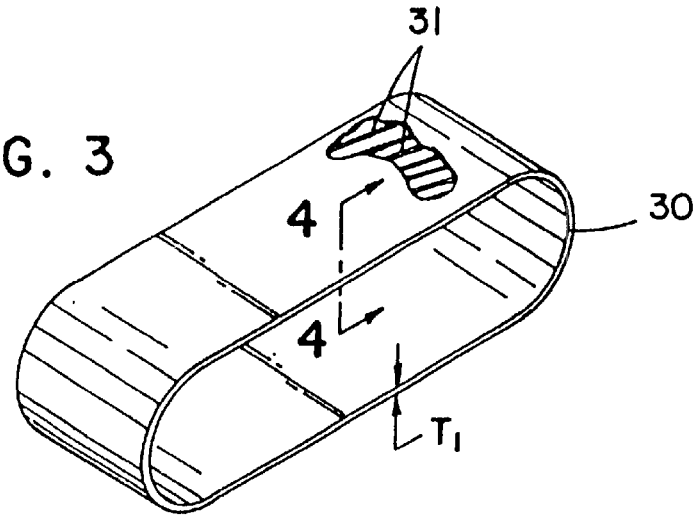
FIG. 3 is a perspective view of an endless, seamless, backing loop according to the invention.

Referring to the various views of the backing of an endless belt of the present invention shown in FIGS. 3 to 6 (not shown to scale), it is preferred that the fibrous reinforcing material, particularly the individual reinforcing strands, be present in a coated abrasive backing construction in a predetermined, i.e., not random, position or array. For example, for the backing loop 30 of FIG. 3, the individual wraps 31 in the layer of reinforcing fibrous strands are oriented to extend in the machine direction, i.e., the longitudinal direction, of the backing loop 30; FIG. 3 being a representation of the endless, seamless backing loop without any abrasive material or adhesive layers coated thereon, and with a portion of an internal layer of reinforcing strands exposed.

As shown in FIG. 4, which is an enlarged fragmentary cross-sectional view of the endless, seamless backing loop 30 taken generally along line 4—4, FIG. 3, the fibrous reinforcing material is present in two distinct layers 32 and 33 with solidified organic binder layers 34, 35, and 36 above, between, and below the layers of fibrous reinforcing material 32 and 33. One layer (33) is oriented above and separate from the other layer (32) by a layer of organic binder material 35. Layer 33 is a layer of fibrous strands with the wraps 31 in extension in the longitudinal direction of the backing loop. Layer 32 is a layer of a fibrous reinforcing mat or web. This orientation of the strands in the longitudinal direction of the backing provides advantageous characteristics, particularly tensile strength, i.e., resistance to tearing in the longitudinal direction of the backing loop.

Although not shown in any particular figure, the reinforcing fibrous strands can alternatively be oriented to extend in the cross direction of a coated abrasive backing, or at least to approach the cross direction. Furthermore, for alternative embodiments not shown in any particular figure, alternate layers of reinforcing strands can be oriented to extend in both the longitudinal and cross direction, respectively, of the coated abrasive backing as a grid, if so desired. A significant improvement in cross tear resistance is realized when the fibers are extended in the cross direction, and segments may be spliced together to form segmented backing loops.

Referring to the embodiment of FIG. 5, which is an enlarged fragmentary cross-sectional view of an endless, seamless backing loop according to the present invention taken generally analogously along line 4—4, FIG. 3. The backing 50 has one layer of fibrous reinforcing mat structure 52 in the internal structure of the backing 50. The embodiment shown in FIG. 5 shows a fibrous reinforcing mat structure with individual parallel fibrous strands 53 incorporated therein. Although not specifically shown in FIG. 5, the layer of fibrous reinforcing mat structure typically consists of at least two wraps of the reinforcing mat.

If there is only one layer of a fibrous mat structure or one layer of fibrous reinforcing strands used, the layer is preferably oriented in the center portion of the backing thickness, although it can be positioned toward one of the outer surfaces of the backing. That is, if there is only one layer of a fibrous reinforcing material in a backing of the present invention, it is not on, or at, the surface of the backing; rather it is engulfed within the internal structure of the backing. Thus, at the outer and inner surfaces of an endless, seamless backing loop there is generally no exposed fibrous reinforcing material.

Referring to the embodiment of FIG. 6, which is an enlarged fragmentary cross-sectional view of an endless, seamless backing loop according to the present invention taken generally analogously along line 4—4, FIG. 3, the backing 60 has three parallel layers, i.e., planes, 62, 63, and 64 of fibrous reinforcing material. These three layers 62, 63, and 64 are separated from one another by regions of organic polymeric binder material 65 and 66. These three layers 62, 63, and 64, generally do not overlap, interlock, or cross one another, and are coated by regions of organic binder material 67 and 68 at the surfaces of the backing. Although each of the layers of fibrous reinforcing material could be a layer of reinforcing strands, a layer of a fibrous reinforcing mat or web, or a layer of a fibrous reinforcing mat with reinforcing strands incorporated therein, the embodiment in FIG. 6 shows layers 62 and 64 as layers of fibrous mat structure, and layer 63 as a layer of fibrous strands positioned in the machine, i.e., longitudinal, direction of the backing loop 60.

Backings of the present invention include at least one layer of reinforcing strands, or at least one layer of a fibrous reinforcing mat or web structure, or at least one layer of a fibrous reinforcing mat with reinforcing strands incorporated therein. Preferred backings of the present invention incorporate a plurality of layers of fibrous reinforcing material. More preferred backings of the present invention incorporate at least one layer of a fibrous mat structure and at least one layer of reinforcing strands, for advantageous strength in both the longitudinal and cross directions.

Optional Backing Additives

The backings of the present invention can further and advantageously for certain applications of the present invention include other additives. For example, incorporation of a toughening agent into the backing will be preferred for certain applications. Preferred toughening agents include rubber-type polymers or plasticizers. The preferred rubber toughening agents are synthetic elastomers. Preferably, at least an effective amount of a toughening agent is used. Herein, the term "effective amount" in this context refers to an amount sufficient to impart improvement in flexibility and toughness.

Other materials that can be advantageously added to the backing for certain applications of the present invention include inorganic or organic fillers. Inorganic fillers are also known as mineral fillers. A filler is defined as a particulate material, typically having a particle size less than about 100 micrometers, preferably less than about 50 micrometers. The filler may also be in the form of solid or hollow spheriods, such as hollow glass and phenolic spheroids. Fillers are capable of being dispersed uniformly within the binder material. Examples of useful fillers for applications of the present invention include carbon black, calcium carbonate, silica, calcium metasilicate, cryolite, phenolic fillers, or polyvinyl alcohol fillers. If a filler is used, it is theorized that the filler fills in between the reinforcing fibers, and possibly prevents crack propagation through the backing. Typically, a filler would not be used in an amount greater than about 70 weight % based on the weight of the make coating, and 70 weight % based on the weight of a size coating.

Other useful materials or components that can be added to the backing for certain applications of the present invention are pigments, oils, antistatic agents, flame retardants, heat stabilizers, ultraviolet stabilizers, internal lubricants, antioxidants, and processing aids. Examples of antistatic agents include graphite fibers, carbon black, metal oxides such as vanadium oxide, conductive polymers, humectants and combinations thereof. These materials are further described in U.S. patent application Ser. Nos. 07/893,491, filed Jun. 4, 1992, and 07/834,618, filed Feb. 12, 1992, both of whith are incorporated by reference.

Adhesive Layers

The adhesive layers in the coated abrasive articles of the present invention are formed from a resinous adhesive. Each of the layers can be formed from the same or different resinous adhesives. Useful resinous adhesives are those that are compatible with the organic polymeric binder material of the backing. Cured resinous adhesives are also tolerant of grinding conditions such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, or mixtures thereof.

The first and second adhesive layers, referred to in FIG. 2 as adhesive layers 12 and 15, i.e., the make and size coats, can preferably contain other materials that are commonly utilized in abrasive articles. These materials, referred to as additives, include grinding aids, coupling agents, wetting agents, dyes, pigments, plasticizers, release agents, or combinations thereof. Fillers might also be used as additives in the first and second adhesive layers. Fillers or grinding aids are typically present in no more than an amount of about 70 weight %, for either the make or size coating, based upon the weight of the adhesive. Examples of useful fillers include calcium salts, such as calcium carbonate and calcium metasilicate, silica, metals, carbon, or glass.

The third adhesive layer 16 in FIG. 2, i.e., the supersize coat, can preferably include a grinding aid, to enhance the abrading characteristics of the coated abrasive. Examples of grinding,.aids include potassium tetrafluoroborate, cryolite, ammonium cryolite, or sulfur. One would not typically use more of a grinding aid than needed for desired results.

Preferably, the adhesive layers, at least the first and second adhesive layers, are formed from a conventional calcium salt filled resin, such as a resole phenolic resin, for example. Resole phenolic resins are preferred at least because of their heat tolerance, relatively low moisture sensitivity, high hardness, and low cost. More preferably, the adhesive layers include about 45–55 wt-% calcium carbonate or calcium metasilicate in a resole phenolic resin. Most preferably, the adhesive layers include about 50 wt-% calcium carbonate filler, and about 50 wt-% resole phenolic resin, aminoplast resin, or a combination thereof. Herein, these percentages are based on the weight of the adhesive.

Abrasive Material

Examples of abrasive material suitable for applications of the present invention include fused aluminum oxide, heat treated aluminum oxide, ceramic aluminum oxide, silicon carbide, alumina zirconia, garnet, diamond, cubic boron nitride, or mixtures thereof. The term "abrasive material" encompasses abrasive grains, agglomerates, or multi-grain abrasive granules. An example of such agglomerates is described in U.S. Pat. No. 4,652,275, which is incorporated herein by reference. It is also with the scope of the invention to use diluent erodable agglomerate grains as disclosed in U.S. Pat. No. 5,078,753, also incorporated herein by reference.

A preferred abrasive material is an alumina-based, i.e., aluminum oxide-based, abrasive grain. Useful aluminum oxide grains for applications of the present invention include fused aluminum oxides, heat treated aluminum oxides, and ceramic aluminum oxides. Examples of ceramic aluminum oxides are disclosed in U.S. Pat. Nos. 4,314,827, 4,744,802, and 4,770,671, which are incorporated herein by reference.

The average particle size of the abrasive grain for advantageous applications of the present invention is at least about 0.1 micrometer, preferably at least about 100 micrometers. A grain size of about 100 micrometers corresponds approximately to a coated abrasive grade 120 abrasive grain, according to American National Standards Institute (ANSI) Standard B74.18-1984. The abrasive grain can be oriented, or it can be applied to the backing without orientation, depending-upon the desired end use of the coated abrasive backing.

Alternatively, the abrasive material can be in the form of a preformed sheet material coated with abrasive material that can be laminated to the outer surface of an endless, seamless backing loop. The sheet material can be from cloth, paper, vulcanized fiber, polymeric film forming material, or the like. Alternatively, the preformed abrasive coated laminate can be a flexible abrasive member-as disclosed in U.S. Pat. No. 4,256,467, which is incorporated herein by reference. Briefly, this abrasive member is made of a non-electrically conductive flexible material or flexible material having a nonelectrically conducting coating. This material is formed with a layer of metal in which abrasive material is embedded. The layer of metal is adhered to a mesh material.

Preparation of the Coated Abrasive Articles

A variety of methods can be used to prepare abrasive articles and the backings according to the present invention. Typically the method chosen depends on the type of binder chosen. For the endless, seamless loops of the invention, a preferred method of forming the backing generally involves: preparing a loop of liquid organic polymeric binder material having fibrous reinforcing material therein, in extension around a periphery of a support structure; and solidifying the liquid organic polymeric binder material to form a flexible, solidified, endless, seamless loop having fibrous reinforcing material therein. Although backings of the present invention have the fibrous reinforcing material "engulfed" therein, the method of preparation does not necessarily require that this be so.

The support structure used in such a method is preferably a drum, which can be made from a rigid material such as steel, metal, ceramics, or a strong plastic material. The material of which the drum is made should have enough integrity such that repeated endless, seamless loops can be made without any damage to the drum. The drum is placed on a mandrel so that it can be rotated at a controlled rate by a motor. This rotation can range anywhere from 0.1 to 500 revolutions per minute (rpm), preferably 1 to 100 rpm, depending on the application.

The drum can be a unitary or created of segments or pieces that collapse for easy removal of the endless, seamless loop. If a large endless, seamless loop is preferred, the drum is typically made of segments for collapsibility and easy removal of the loop. If such a drum is used, the inner surface of the loop may contain slight ridges where the segments are joined and form a seam in the drum. Although it is preferred that the inner surface be generally free of such ridges, such ridges can be tolerated in endless, seamless, loops of the present invention in order to simplify manufacture, especially with large belts.

The dimensions of the drum generally correspond to the dimensions of the endless, seamless loops. The circumference of the drum, will generally correspond to the inside circumference of the endless, seamless loops. The width of the endless, seamless loops can be of any value less than or equal to the width of the drum. A single endless, seamless loop can be made on the drum, removed from the drum, and the sides can be trimmed. Additionally, the loop can be spit longitudinally into multiple loops with each having a width substantially less than the original loop.

In many instances, it is preferred that a release coating be applied to the periphery of the drum before the binder or any of the other components are applied. This provides for easy release of the endless, seamless loop after the binder is solidified. In most instances, this release coating will not become part of the endless, seamless loop. If a collapsible drum is used in the preparation of a large endless, seamless loop, such a release liner helps to prevent, or at least reduce, the formation of ridges in the inner surface of the loop, as discussed above. Examples of such release coatings include, but are not limited to, silicones, fluorochemicals, or polymeric films coated with silicones or fluorochemicals. It is also within the scope of this invention to use a second release coating which is placed over the final or top coating of the binder. This second release coating is typically present during the solidification of the binder, and can be removed afterwards.

The thermosetting binder material is typically applied in a liquid state or semi-liquid state to the drum. The application of the binder can be by any effective technique such as spraying, die coating, knife coating, roll coating, curtain coating, or transfer coating. For these coating techniques, the drum is typically rotated as the thermosetting binder is applied. For example, referring to FIG. 7, a thermosetting binder 72 can be applied by a curtain coater 74 set above the drum 76. As the drum 76 rotates, the thermosetting binder 72 is applied to the periphery 77 of the drum 76. It typically takes more than one rotation of the drum to obtain the proper coating of the thermosetting binder, such that the fibrous reinforcing material is fully coated and will be fully surrounded by organic binder material in the final product. The thermosetting binder 72 may also be heated to lower the viscosity and to make it easier to use in the coating process.

It is also within the scope of this invention to use more than one type of binder material for a given backing. When this is done, the two or more types of binder materials, e.g., thermosetting binder materials, can be mixed together prior to the coating step, and then applied to the drum. Alternatively, a first binder material, e.g., a thermosetting resin, can be applied to the drum, followed by a second binder material, e.g., a thermoplastic material. If a thermosetting resin is used in combination with a thermoplastic material, the thermosetting resin may be gelled, or partially cured, prior to application of the thermoplastic material.

For thermosetting resins, the solidification process is actually a curing or polymerization process. The thermosetting resin is typically cured with either time or a combination of time and energy. This energy can be in the form of thermal energy, such as heat or infrared, or it can be in the form of radiation energy, such as an electron beam, ultraviolet. light, or visible light. For thermal energy, the oven temperature can be within a range of about 30–250°C., preferably within a range of about 75–150° C. The time required for curing can range from less than a minute to over 20 hours, depending upon the particular binder chemistry employed. The amount of energy required to cure the thermosetting binder will depend upon various factors such as the binder chemistry, the binder thickness, and the presence of other material in the backing composition.

The thermosetting binder material is preferably partially solidified or cured before the other components, such as the adhesive coats and the abrasive grain, are applied. The binder material can be either partially or fully polymerized or cured while remaining on the drum.

The fibrous reinforcing material can be applied to the drum in several manners. Primarily, the particular method is dictated by the choice of fibrous material. A preferred method for applying a continuous individual reinforcing fibrous strand involves the use of a level winder. In this method, the drum is rotated while the reinforcing fibrous strand is initially attached to the drum, is pulled through the level winder, and is wound around the drum helically across the width of the drum, such that a helix is formed in longitudinal extension around the length of the drum. It is preferred that the level winder move across the entire width of the drum such that the continuous reinforcing fibrous strand is uniformly applied in a layer across the drum. In this embodiment, the strand is in a helically wound pattern of a plurality of wraps in a layer within the organic polymeric binder material, with each wrap of the strand parallel to and in contact with the previous wrap of the strand.

If the level winder does not move across the entire width of the drum, the reinforcing fibrous strands can be placed in the backing in a specific portion along the width of the seamless, endless loop. In this way, regions in which reinforcing fibrous strands are present in one plane can be separated from each other without overlap. For advantageous strength, however, the fibrous reinforcing strands are in a continuous layer across the width of the belt backing.

The level winder can also contain an orifice such that as the fibrous strand proceeds through the orifice it is coated with a binder material. The diameter of the orifice is selected to correspond to the desired amount of binder.

Additionally, it may be preferable to wind two or more different yarns side by side on the level winder. It is also preferable to wind two or more different yarns at a time into the backing. For example, one yarn may be made of fiberglass and another may be polyester.

A chopping gun can also be used to apply the fibrous reinforcing material. A chopping gun projects the fibers onto the resin material on the drum, preferably while the drum is rotating and the gun is held stationary. This method is particularly suited when the reinforcing fibers are small, i.e., with a length of less than about 100 millimeters. If the length of the reinforcing fiber is less than about 5 millimeters, the reinforcing fiber can be mixed into and suspended in the binder. The resulting binder/fibrous material mixture can then be applied to the drum in a similar manner as discussed above for the binder.

In certain applications of the present invention, the binder is applied to a rotating drum, and the fibrous reinforcing material is then applied. The binder will then typically wet the surfaces of the reinforcing material. In preferred applications of the present invention, the fibrous reinforcing material is coated with the binder and then the binder/fibrous material is applied to the drum.

If the fibrous material is in the form of a mat or web, such as a nonwoven or woven mat, the mat is applied by directing it from an unwind station and wrapping it around the drum as the drum rotates. Depending upon the particular construction desired, there can be more than one wrap of the fibrous mat structure around the drum. Preferably, there are at least two wraps of the fibrous mat in each "layer" of the fibrous mat structure. In this way a discreet seam in the layer is avoided.

The fibrous mat structure can be combined with the organic polymeric binder material in several manners. For example, the mat can be applied directly to the binder material that has been previously applied to the drum, the mat can be applied to the drum first followed by the binder material, or the mat and the binder material can be applied to the drum in one operation.

In preferred applications of the present invention, the fibrous mat structure is coated or saturated with the organic polymeric binder material prior to application to the drum. This method is preferred at least because the amount of binder material can be more easily monitored. This coating or saturation can be done by any conventional technique such as roll coating, knife coating, curtain coating, spray coating, die or dip coating.

Figure 8:
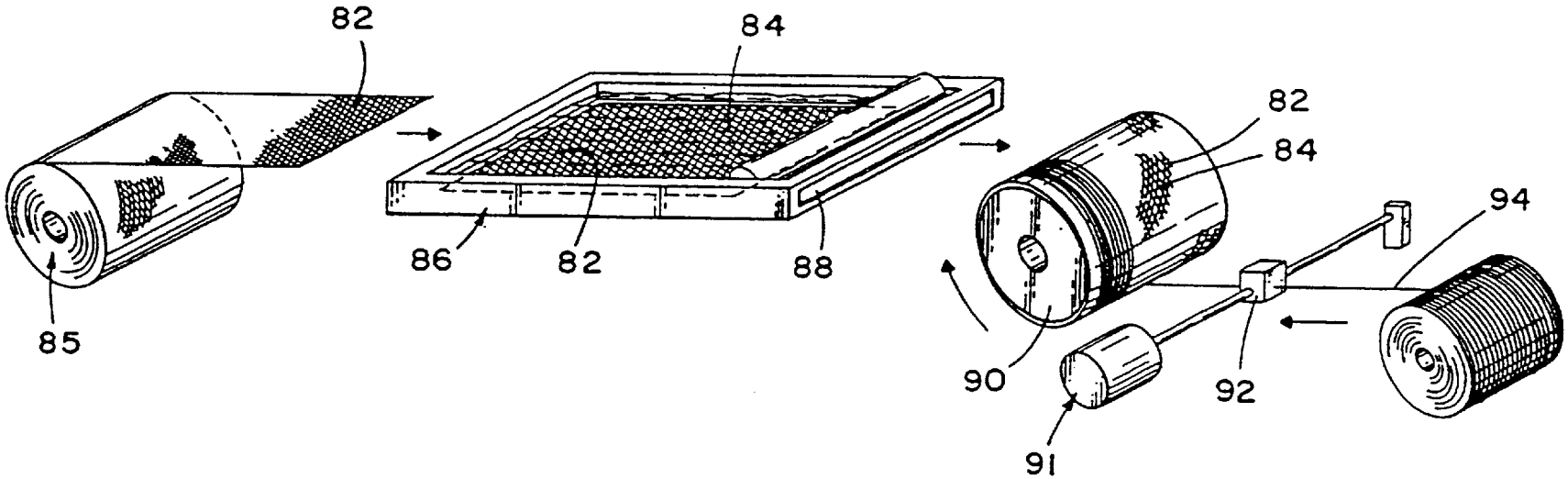
FIG. 8 is a schematic of a preferred process of the present invention for making an endless, seamless backing loop containing both a fibrous reinforcing mat structure and a layer of a continuous fibrous reinforcing strand engulfed within a thermosetting resin.

Referring to FIG. 8, in a preferred method for preparing a preferred backing loop of the present invention, the fibrous mat structure 82 is saturated with the organic polymeric binder material 84 as it is removed from an unwind station 85. The amount of binder material 84 applied is determined by a knife coater 86, in which a gap 88 in the knife coater controls the amount of polymeric binder material 84 applied.

The mat/liquid binder composition (82/84) is then applied to a drum 90 in at least one layer, i.e., such that the mat/liquid binder composition (82/84) is wrapped completely around the drum at least once. Although the finished backing structure is seamless, there is a seam in the internal structure of an endless, seamless loop made in this manner. To avoid such a seam, it is preferable to wrap the mat/liquid binder composition (82/84) around the drum 90 at least twice. The binder wets the surface of the fibrous mat structure prior to solidification such that upon curing a unitary, endless, seamless, construction is achieved.

If a layer of a continuous individual reinforcing fibrous strand is used as well, the process described above can be used in its application. Referring to FIG. 8, the method involves the use of a yarn guide system 91 with a level winder 92. In this method, the drum 90 is rotated while the reinforcing fibrous strand 94 is initially attached to the drum 90, is pulled through the level winder 92, and is wound around the drum 90 helically across the width of the drum, such that the layer of the strand 94 is no wider than the layer of the mat 82. It is preferred that the level winder 92 move across the width of the drum such that the continuous reinforcing fibrous strand 94 is uniformly applied in a layer across the width of the mat 82. Thus, the strand 94 is in a helically wound pattern of a plurality of wraps in a layer within the organic polymeric binder material, with each wrap of the strand parallel to and in contact with the previous wrap of the strand. Furthermore, the individual wraps of the strand 94 are at a constant nonzero angle relative to the parallel side edges of the mat 82. Sufficient uncured thermosetting resin 84 is applied to the mat 82 to provide a layer of resin at least above and below the reinforcing material, i.e., on the outer and inner surfaces of the loop. Furthermore, there is a layer of resin between the mat 82 and layer of fibrous strand 94, if sufficient resin is used.

It is also within the scope of this invention to make non-uniform endless, seamless backing loops. In non-uniform backing loops there will be at least two distinct regions where the composition and/or amount of materials are not uniform. This non-uniformity can either be throughout the length of the backing loop, the width of the backing loop or both the length and width of the backing loop. The composition non-uniformity can be attributed to either the binder material, the fibrous reinforcing material or any optional additives. The non-uniformity can also be associated with different materials in different regions of the backing loop or the lack of a material in certain regions of the backing loop.

Figure 10:
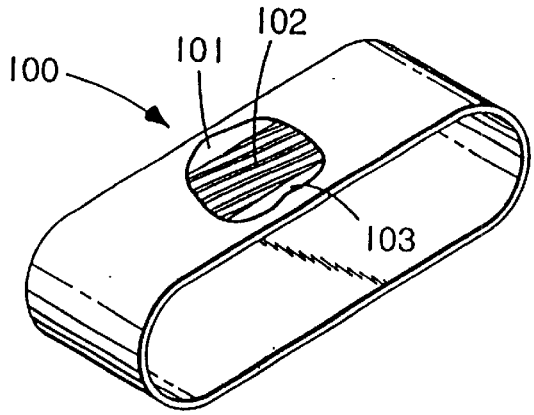
FIG. 10 is a perspective view of another embodiment of an endless, seamless backing loop wherein reinforcing yarns are located only near the center of the loop.
Figure 11:
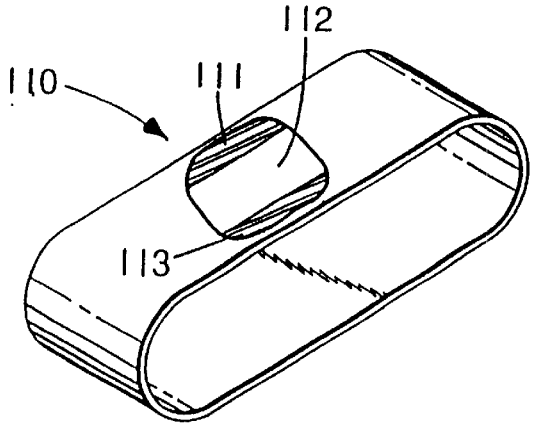
FIG. 11 is a perspective view of still another embodiment of an endless, seamless backing loop wherein reinforcing yarns are located only at the edges of the loop.
Figure 12:
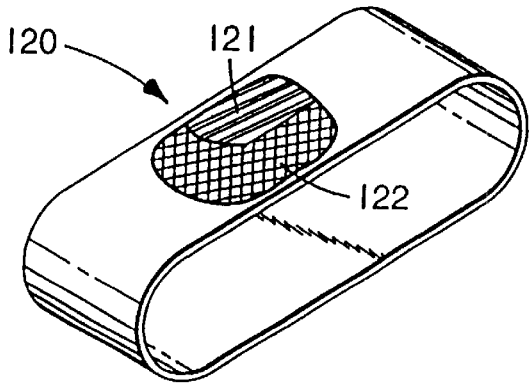
FIG. 12 is a perspective view of yet another embodiment of an endless, seamless backing loop wherein one region comprises a binder, a reinforcing strand and a reinforcing mat, and the second region comprises only a binder and a reinforcing mat.

FIGS. 10 through 12 illustrate three embodiments of non-uniform backing loops. Referring to FIG. 10, the backing loop 100 has three regions 101, 102, 103. The center of the backing loop 102 has a reinforcing yarn, whereas the adjacent regions 101 and 102 do not have reinforcing yarns. Regions 101 and 102 are made solely of binder material. The resulting backing loop will tend to have more flexible edges. Referring to FIG. 11, the backing loop 110 has three regions, 111, 112 and 113. Center 112 of the backing loop is made essentially of only the binder, the regions adjacent to center region 111 and region 113 comprise binder and reinforcing material. Referring to FIG. 12, backing loop 120 has two regions 121 and 122. In region 122, the backing loop comprises a binder, reinforcing strands and a reinforcing mat. In region 121, the backing loop comprises only a binder and reinforcing fibers. There are many combinations of binder, reinforcing strands, reinforcing mats, additives and the amounts of such materials. The particular selection of these materials and their configuration is dependent upon the desired application for the coated abrasive made using the backing loop. For instance, the backing loop described above and illustrated in FIG. 10 may have applications for an abrading operation where it is desired to have flexible edges on the coated abrasive.

The backing loop described above and illustrated in FIG. 11 may have applications for abrading operations in which it is desired to have strong edges to prevent the edges from tearing.

There are many different methods to make a non-uniform backing loop. In one method, the level winder only winds the fibrous strands in certain regions of the drum. In another method, a chopping gun places the reinforcing material in certain regions. In a third method, the reinforcing yarns are unwound from a station and wound upon the drum in only certain regions. In still another approach, the binder material is only placed or coated on certain-regions of the drum. It is also within the scope of the invention to use a combination of all of the different approaches.

There are several ways in which the optional additives can be applied. The method of application depends upon the particular components. Preferably, any additives are dispersed in the binder prior to the binder being applied to the drum. In some situations, however, the addition of additive to the binder results in either a thixotropic solution or a solution that has too high a viscosity to process. In such a situation, the additive is preferably applied separately from the binder material. For example, the binder material can be applied to the drum first, and while it is in a "tacky" state, additives can be applied. Preferably, the drum with the binder material rotates while the additive is either drop coated onto the drum or projected onto the drum. With either method, the additive can be uniformly applied across the width of the drum or concentrated in a specific area. Alternatively, the additive(s) can be applied to the fibrous reinforcing material, and the fiber/additive(s) combination can be applied to the drum.

To make the endless, seamless backing loops of the present invention, there should be enough binder material present to completely wet the surface of the fibrous reinforcing material and additives. If necessary, an additional layer of binder material can be applied after these components are added to the binder. Additionally, there should be enough binder material present such that the binder material seals the surfaces of the backing and provides relatively "smooth" and uniform surfaces, as discussed previously.

Figure 9:
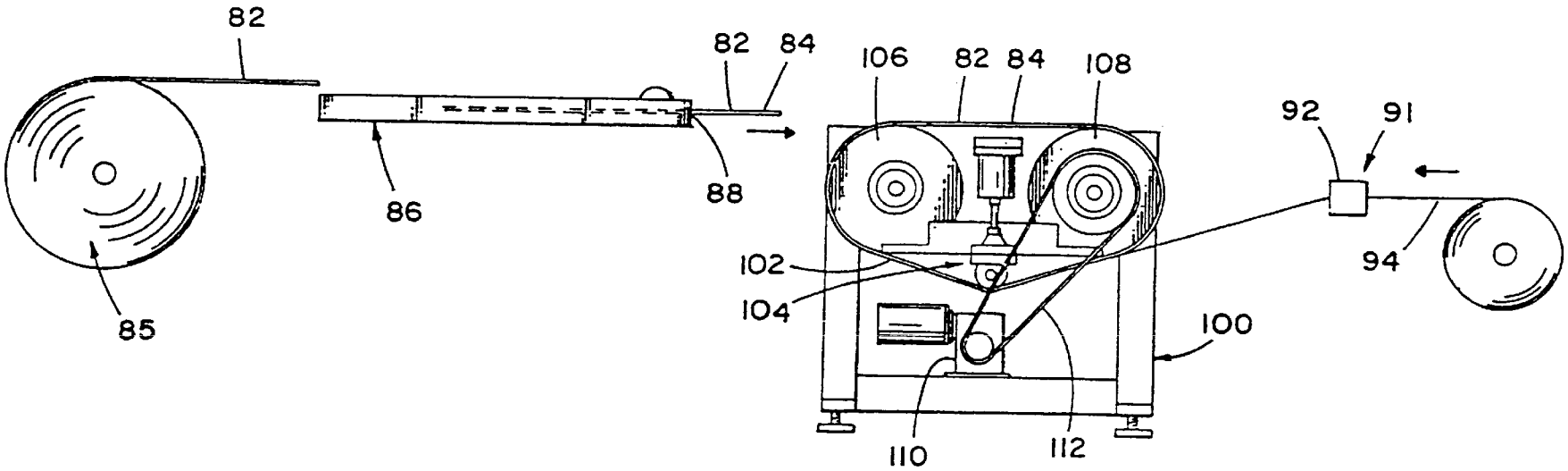
FIG. 9 is a schematic of an alternative process for making an endless, seamless backing loop using a conveyor system in place of a drum in a process for making an endless, seamless backing loop.

FIG. 9 illustrates an alternative embodiment of a process for forming an endless, seamless backing of the present invention. This process is similar to that shown in FIG. 8, but uses an alternative support structure. In this embodiment the process uses a conveyor unit 100. This particular procedure illustrates the general method of making a backing of an endless, seamless loop utilizing a thermosetting binder material, although a thermoplastic material could also be used. The backing is formed on a sleeve 102, i.e., in the form of a belt. The sleeve 102 is preferably a stainless steel sleeve. The stainless steel sleeve 102 can be coated with a silicone release liner, i.e., material, on the outer surface of the sleeve for easy removal of the endless, seamless loop formed. The sleeve 102 can be of any size desired. A typical example is in the form of a belt 0.4 mm thick, 10 cm wide, and 61 cm in circumference. This sleeve 102 is typically mounted on a two idler, cantilevered, drive system 104 that rotates the sleeve 102 at any desired rate. The drive system 104 consists of two drive idlers 106 and 108, a motor 110 and a belt drive means 112.

The procedures described herein with respect to forming an endless, seamless loop for a coated abrasive belt on a drum, apply also to the forming of a loop on this conveyor unit 100. For example, analogously to the method discussed in FIG. 8, a nonwoven web 82 is saturated with a liquid organic binder material 84 by means of a knife coater 86. The resulting saturated material, i.e., mat/liquid binder composition (82/84) is then preferably wrapped twice around the outer surface, i.e., periphery, of the sleeve 102 as it rotates on the drive system 104, at a rate, for example, of 2 revolutions per minute (rpm). A single reinforcing fibrous strand 94 can then be wrapped over the saturated nonwoven web, i.e., mat/liquid binder composition (82/84) by means of a yarn guide system 91 with a level winder 92 that moves across the face of the drive idler 108 as the sleeve 102 rotates on the drive system 104. The sleeve 102 typically rotates at a speed of 50 rpm. This results in a backing with a distinct layer of fibrous reinforcing strands with a spacing of about 10 strands per cm of width. This strand spacing can be changed by increasing or decreasing the rate of rotation of the sleeve or by increasing or decreasing the speed of the yarn guide. After the binder is cured, the sleeve can be removed and the endless, seamless backing loop separated from the sleeve.

After the endless, seamless backing loop is fabricated, a first adhesive layer, i.e., a make coat, is applied to the backing. The abrasive material, preferably in the form of a plurality of abrasive grains, is then applied to the first adhesive layer. The first adhesive layer with abrasive grains embedded therein is at least partially solidified. If the adhesive layer is a thermosetting resin, this solidification process is actually a curing or polymerization process. Typically, this involves the use of energy, either thermal or radiation energy. Following this, a second adhesive layer, i.e., a size coat, is applied over the abrasive grains and the first adhesive layer. Both adhesive layers are then fully solidified.

Alternative applications of the adhesive and abrasive material are within the scope of this invention. For example, an abrasive slurry consisting of a plurality of abrasive grains dispersed in an adhesive can be prepared. This abrasive slurry can be applied to the backing in a variety of manners, and the adhesive solidified.

The abrasive material can also be applied using a preformed abrasive coated laminate. This laminate consists of a sheet of material coated with abrasive grains. The sheet of material can be a piece of cloth, polymeric film, vulcanized fiber, paper, nonwoven web such as that known under the trade designation "Scotch-Brite". Alternatively, the laminate can be that disclosed in U.S. Pat. No. 4,256,467, which is incorporated herein by reference. The laminate can be applied to the outer surface of the backing of the present invention using: any of the adhesives discussed above; thermobonding; a pressure sensitive adhesive; or mechanical fastening means, such as a hook and loop means, as is disclosed in U.S. Pat. No. 4,609,581, which is incorporated herein by reference. This could include a method of attachment by which the laminate is applied to a liquid loop of backing binder and reinforcing fiber such that the laminate is attached by curing or solidifying the liquid backing loop. This embodiment of the coated Abrasive article of the present invention is advantageous at least because of the potential for removing the laminate once the abrasive material is exhausted and replacing it with another such laminate. In this way the backing of the present invention can be reused. Alternatively, another advantage is that the overall construction does not have a splice.

An alternative embodiment of the present invention comprises an article wherein the abrasive layer is an endless, seamless loop which is attached to a preformed material, the preformed material being adhered to the inside surface of the loop. This embodiment allows for reuse of the preformed material. The abrasive loop, which will normally wear out with use, may be replaced. In this embodiment, the preformed material may have a seam, but the abrasive loop is seamless.

In preparation of a coated abrasive belt of the present invention, the backing loop can be installed around two drum rollers, which are connected to a motor for rotating the backing. Alternatively, the backing can be installed around one drum roller, which is connected to a motor for rotating the backing. Preferably, this drum roller can be the same as the drum used in the preparation of the endless, seamless backing loop. As the backing rotates, the adhesive layers or abrasive slurry are applied by any conventional coating technique such as knife coating, die coating, roll coating, spray coating, or curtain coating. Spray coating is preferred for certain applications.

If an abrasive slurry is not used, i.e., if the abrasive material is applied after the first adhesive layer is applied, the abrasive grains can be electrostatically deposited onto the adhesive layer by an electrostatic coater. The drum roller acts as the ground plate for the electrostatic coater. Alternatively, the abrasive grains can be applied by drop coating.

Preferably, the first adhesive layer is solidified, or at least partially solidified, and a second adhesive layer is applied. The second adhesive layer can be applied by any conventional method, such as roll coating, spray coating, or curtain coating. The second adhesive layer is preferably applied by spray coating. The adhesive layer(s) can then be fully solidified while the backing is still on the drum rollers. Alternatively, the resulting product can be removed from the drum rollers prior to solidification of the adhesive layer(s).

If the components forming the backing of the invention include a thermoplastic material, they could be injection molded. Alternatively, there are several different methods that can be used to apply a thermoplastic binder to a hub, i.e., drum roller. For example, a solvent can be added to the thermoplastic binder such that the thermoplastic can flow. In this method the thermoplastic binder can be applied to the hub by any technique such as spraying, knife coating, roll coating, die coating, curtain coating, or transfer coating. The thermoplastic binder is then solidified by a drying process to remove the solvent. The drying conditions will depend upon the particular solvent employed and the particular thermoplastic binder material employed. Typical drying conditions include temperatures within a range of about 15–200° C., preferably 30–100° C.

Alternatively, the thermoplastic binder can be heated above its softening point, and preferably above its melting point, such that it can flow. In this method, the thermoplastic binder material can be applied to the hub by any technique such as spraying, knife coating, roll coating, die coating, curtain coating, or transfer coating. The thermoplastic material is then solidified by cooling.

In a third method, the thermoplastic binder material can be applied in a solid or semi-solid form. This method is preferred for certain applications of the present invention. Typically, a segment of a thermoplastic material is cut and, applied to the drum. The fibrous reinforcing material and any additives or other components are then applied to the hub. A second segment of a thermoplastic material is then applied over the fibrous reinforcing material. The hub/thermoplastic material are then heated to above the softening point, and preferably to above the melting point, of the thermoplastic binder material such that the thermoplastic binder flows and fuses all the components of the backing. The thermoplastic binder material is then cooled and resolidified.

There are various alternative and acceptable methods of injection molding the coated abrasive backing of the present invention. For example, the reinforcing fibers can be blended with the thermoplastic material prior to the injection molding step. This can be accomplished by blending the fibers and thermoplastic in a heated extruder and extruding pellets.

If this method is used, the reinforcing fiber size or length will typically range from about 0.5 millimeter to about 50 millimeters, preferably from about 1 millimeter to about 25 millimeters, and more preferably from about 1.5 millimeter to about 10 millimeters.

Alternatively, and preferably, so as to form a distinct layer of reinforcing material, a woven mat, a nonwoven mat, or a stitchbonded mat of the reinforcing fiber can be placed into the mold. The thermoplastic material and any optional components can be injection molded to fill the spaces between the reinforcing fibers. In this aspect of the invention, the reinforcing fibers can be oriented in a desired direction. Additionally, the reinforcing fibers can be continuous fibers with a length determined by the size of the mold.

After the backing is injection molded, then the make coat, abrasive grains, and size coat can be typically applied by conventional techniques to form the coated abrasive articles of the present invention. Using these methods described, the mold shape and dimensions generally correspond to the desired dimensions of the backing of the coated abrasive article.

Elastomeric binders can be solidified either via a curing agent and a curing or polymerization process, a vulcanization process or the elastomeric binder can be coated out of solvent and then dried puring processing, the temperatures should not exceed the melting or degradation temperatures of the fibrous reinforcing material.

In certain applications of the invention, a material such as cloth, polymeric film, vulcanized fiber, nonwoven, fibrous reinforcing mat, paper, etc., treated versions thereof, or combinations thereof can be laminated to the endless, seamless backing of the invention. Alternatively, a coated abrasive article as described in U.S. Pat. No. 4,256,467 can be used as a laminate. A laminate such as this can be used to further improve the belt tracking, wear properties, and/or adhesive properties. It can be used to impart economy and ease in manufacture, strength to the end-product, and versatility. The material can be laminated to either the outer, i.e., grinding, surface of the belt, or to the inner surface.

EXAMPLES

The present invention will be further described by reference to the following detailed examples.

General Information

The amounts of material deposited on the backing are reported in grams/square meter ($g/m^2$), although these amounts are referred to as weights; all ratios are based upon these weights. The following designations are used throughout the examples.

PET1NW a spunbonded polyester nonwoven mat approximately 0.127 mm thick and weighed approximately 28 $g/m^2$. It was purchased from the Remay Corporation, Old Hickory, Tenn., under the trade designation "Remay."

PET polyethylene terephthalate.

PVC polyvinyl chloride.

PU polyurethane.

ER1 a diglycidyl ether of bisphenol A epoxy resin commercially available from Shell Chemical Co., Houston, Tex., under the trade designation "Epon 828."

ECA a polyamide curing agent for the epoxy resin, commercially available from the Henkel Corporation, Gulph Mill, Pa., under the trade designation "Versamid 125."

ER2 an aliphatic diglycidyl ether epoxy resin commercially available from the Shell Chemical Co., Houston, Tex., under the trade designation "Epon 871."

SOL an organic solvent, having the trade designation "Aromatic 100,". commercially available from Worum Chemical Co., St. Paul, Minn.

GEN an amidoamine resin, known under the trade designation "Genamid 747", from Henkel Corporation.

Procedure I for Preparing an Endless, Seamless Backing

This procedure illustrates the general method of making a backing of an endless, seamless loop utilizing a thermoset binder material. The backing was formed on an aluminum hub having a diameter of 19.4 cm and a circumference of 61 cm. The aluminum hub had a wall thickness of 0.64 cm and was installed on a 7.6 cm mandrel rotated by a DC motor capable of rotating from 1 to 40 revolutions per minute (rpm). Over the periphery of the hub was a 0.13 millimeter thick silicone coated polyester film, which acted as a release surface. This silicone coated polyester film was not part of the backing. The final dimensions of the loop were 10 cm wide by 61 cm long.

A nonwoven web approximately 10 cm wide was saturated with a thermoset binder material by means of a knife cater with a gap set at 0.3 mm. The resulting saturated material was wrapped twice around the hub as the hub rotated at approximately 5 rpm. Next, a single reinforcing fibrous strand was wrapped over the saturated nonwoven web by means of a yarn guide system with a level winder that moved across the face of the hub at about 2.5 cm per minute. The hub was rotating at 23 rpm. This resulted in a backing with a distinct layer of fibrous strands with a spacing of 9 strands per cm of width. The strand spacing was changed by the increase or decrease in the rate of rotation of the hub or the increase or decrease in the speed of the yarn guide. Next, a third layer of the nonwoven web, which was not saturated with binder, was wrapped on top the reinforcing fibrous strands. This nonwoven layer absorbed the excess thermoset binder material. Quartz element IR heaters placed 20 cm from the hub were used to gel the resin. This took 10–15 minutes with the construction at about 94° C.

Procedure II for Preparing an Endless, Seamless Backing

This procedure illustrated the general method of making a backing of an endless,. seamless loop utilizing a thermoplastic binder material. The backing was formed on the same aluminum hub as described in the Procedure I. The hub also contained the silicone coated polyester release film. A sample of 0.13 mm thick thermoplastic binder material was cut into strips that were about 10 cm wide. These thermoplastic strips were wrapped around the hub two times. Next, a single layer of a nonwoven web was wrapped around the hub on top of the thermoplastic binder material. Over the nonwoven was wrapped a reinforcing fibrous strand in a manner similar to that described in Procedure I. Then an additional thermoplastic strip was wrapped around the hub over the reinforcing fibrous strands. Finally another layer of silicone coated polyester film was wrapped around the hub over the thermoplastic film. Again the silicone coated polyester film was not part of the backing. The resulting construction and hub was placed in an oven and heated to the point where the thermoplastic binder material fused the nonwoven and the reinforcing materials together. For PVC and PU, fusion occurs at 218° C. during a period of 30 minutes. Next, the construction and hub was removed from the oven and cooled. The top. layer of the silicone polyester film was removed.

General Procedure for Making the Coated Abrasive

The backing for each example was installed on the aluminum hub/mandrel assembly as described in "Procedure I for Preparing the Backing," as the hub rotated at 40 rpm. A make coat, i.e., first adhesive layer, was applied by an air spray gun to the outer surface of the backing loop. It took between 30 to 40 seconds to spray the make coat, i.e., first adhesive layer, onto the backing. The make coat was 70% solids in solvent (comprising 10% "Polysolve" and 90% water) and consisted of 48% resole phenolic resin and 52% calcium carbonate filler. "Polysolve" 1984PM water blend containing 15% water and 85% propylene glycol monomethyl ether is available from Worum Chemical Co. in St. Paul, Minn. The make coat adhesive wet weight was about 105 g/m$^2$. Next, grade 80 heat treated aluminum oxide was electrostatically coated onto the make coat with a weight of about 377 g/m$^2$. The hub acted as a ground for the electrostatic coating process and a hot plate was placed directly below the hub. For this electrostatic coating process, the abrasive grain was placed on the hot plate. The hub containing the backing/make coat was rotated at 40 rpm and the mineral was coated in about 30 seconds over the backing/make coat to achieve full coverage of the abrasive grain. Next, the resulting coated abrasive article was thermally precured in a box oven for 90 minutes at 88° C. A size coat was then sprayed in the same manner as was the make coat over the abrasive grains and precured make coat. The size coat adhesive wet weight was about 120 g/m$^2$. The size coat, i.e., second adhesive layer, consisted of the same formulation as the make coat.

The resulting coated abrasive product received a thermal cure of 90 minutes at 88° C. and a final cure of 10 hours at 100° C. Prior to testing according to the Particle Board Test, the coated abrasive was flexed, i.e., the abrasive coating was uniformly and directionally cracked, using a 2.54 cm supported bar.

Particle Board Test

The coated abrasive belt (10 cm×61 cm) was installed on a take-about belt type grinder. The workpiece for this test was 1.9 cm×9.5 cm×150 cm industrial grade, 20.4 kg density, low emission urea-formaldehyde particle board available from Villaume Industries, St. Paul, Minn. Five workpieces were initially weighed. Each workpiece was placed in a holder with the 9.5 cm face extending outward. A 15.3 kg load was applied to the workpiece. The 9.5 cm face was. abraded for 30 seconds. The workpiece was reweighed to determine the amount of particle board removed or cut. The total cut of the five workpieces were recorded. This sequence was repeated 5 times for each workpiece for a total of 12.5 minutes of grinding. The control example for this test was a 3M 761D grade 80 "Regalite" Resin Bond Cloth coated abrasive, commercially available from the 3M Company, St. Paul, Minn. The grinding results can be found in Table 1. The percentage of control was determined by: dividing the cut associated with the particular example by the cut associated with the control example, times 100.

Examples 1 through 10

The backing for this set of examples was made according to "Procedure I for Preparing the Backing" and the coated abrasives were made according to the "General Procedure for Making the Coated Abrasive." The nonwoven mat was PET1NW and the thermoset binder material consisted of 40% ER1, 40% ECA, and 20% ER2. The thermoset binder material was diluted to 95% solids with SOL. The ratio of resin to nonwoven web was about 15:1. For each example a different reinforcing fibrous strand was utilized.

Example 1

For example 1 the reinforcing fiber was 1000 denier polyester multifilament yarn, commercially available from Hoechst Celanese, Charlotte, N.C., under the trade designation "T-786." The backing contained a strand spacing of approximately 9 strands/cm.

Example 2

For example 2 the reinforcing fiber was 28 gauge chrome bare wire, commercially available from Gordon Company, Richmond, Ill., under the catalog number 1475 (R27510). The backing contained a strand spacing of approximately 9 strands/cm.

Example 3

For example 3 the reinforcing fiber was a ring spun polyester cotton count 12.5, commercially available from West Point Pepperell, under the trade designation "T-310," 12.3/1, 100% polyester, Unity Plant Lot 210. The backing contained approximately 12 strands/cm.

Example 4

For example 4 the reinforcing fiber was 1800 denier polyester multifilament yarn, commercially available from Hoechst Celanese, Charlotte, N.C., under the trade designation "T-786." The backing contained approximately 5 strands/cm.

Example 5

For example 5 the reinforcing fiber was 55 denier polyester multifilament yarn, commercially available from Hoechst Celanese under the trade designation "T-786." The backing contained approximately 43 strands/cm.

Example 6

For example 6 the reinforcing fiber was 550 denier polyester multifilament yarn, commercially available from Hoechst Celanese under the trade designation "T-786." The backing contained approximately 18 strands/cm.

Example 7

For example 7 the reinforcing fiber was 195 denier aramid multifilament yarn, commercially available from DuPont, Wilmington, Del., under the trade designation "Kevlar 49." The backing contained approximately 12 strands/cm.

Example 8

For example 8 the reinforcing fiber was 250 denier polypropylene multifilament yarn, commercially available from Amoco Fabric and Fibers Co., Atlanta, Ga., under the trade designation "1186." The backing contained approximately 12 strands/cm.

Example 9

For example 9 the reinforcing fiber was a ring spun cotton yarn, cotton count 12.5, commercially available from West Point Pepperell, West Point, Ga., under the trade designation "T-680." The backing contained approximately 12 strands/cm.

Example 10

For example 10 the reinforcing fiber was a fiberglass roving 1800 yield, commercially available form Manville Corp., Denver, Colo., under the trade designation "Star Roving 502, K diameter." The backing contained approximately 6 strands/cm.

Examples 11 through 15

The backing for this set of examples was made according to "Procedure I for Preparing the Backing," with slight modifications as indicated. The coated abrasives were made according to the "General Procedure for Making the Coated Abrasive." The thermoset binder material consisted of 40% ER1, 40% ECA, and 20% ER2. The thermoset binder material was diluted to 95% solids with SOL. The reinforcing fiber for this set of examples was 1000 denier multifilament polyester yarn, commercially available from the Hoechst Celanese, Charlotte, N.C., under the trade designation "Trevira T-786." There were 9 reinforcing strands/cm. For each example a different nonwoven mat was utilized.

Example 11

For example 11 the nonwoven mat was a spunbonded polypropylene that was approximately 0.2 millimeter thick with a weight of 43 g/m$^2$, commercially available from Remay Inc., Old Hickory, Tenn., under the trade designation "Typar" Style 3121. There was no third layer of nonwoven mat in this example. The ratio of thermoset binder to nonwoven was about 15:1.

Example 12

For Example 12 the nonwoven mat was a spunbonded polyester that was approximately 0.3 millimeter thick with a weight of 72 g/m$^2$, commercially available from Remay Inc. under the trade designation "Remay" Style 2405. There was no third layer of nonwoven mat in this example. The ratio of thermoset binder to nonwoven was about 10:1.

Example 13

For Example 13 the nonwoven mat was a spunbonded polyester that was approximately. 0.11 millimeter thick with a weight of 21 g/m$^2$, commercially available from Remay Inc. under the trade designation "Remay" Style 2205. The ratio of thermoset binder to nonwoven was about 14:1.

Example 14

For Example 14 the nonwoven mat was an aramid based nonwoven with approximately 2.5 cm long fibers. The nonwoven was. approximately 0.1 millimeter thick with a weight of 9 g/m$^2$, commercially available from International Paper, Purchase, N.Y. under the trade designation "8000032/0418851." The ratio of thermoset binder to nonwoven was about 27:1.

Example 15

For Example 15 the nonwoven mat was a continuous spun fiberglass mat that was approximately 0.25 millimeter thick with a weight of 42 g/m$^2$, commercially available from Fibre Glast Inc., Dayton, Ohio, under the trade designation "Plast" 260. The ratio of thermoset binder to nonwoven mat was about 10:1.

Examples 16 through 20

The backing for this set of examples was made according to "Procedure I for Preparing the Backing" and the coated abrasives were made according to the "General Procedure of Making the Coated Abrasive." The nonwoven material was PET1NW. The reinforcing fiber for this set of examples was 1000 denier multifilament polyester yarn, commercially available from Hoechst Celanese under the trade designation "Trevira T-786." There were approximately 9 reinforcing strands/cm. For each example a different thermoset material was employed.

Example 16

The thermoset binder material for Example 16 consisted of 20% silica filler, 68% isophthalic polyester resin, commercially available from Fibre Glast Corp., under the trade designation "Plast #90," and 12% polyglycol commercially available from Dow Chemical Co., Midland, Mich., under the trade designation "E400." This example did not contain the third layer of the nonwoven. The ratio of thermoset binder to nonwoven was about 15:1.

Example 17

The thermoset binder material for Example 17 consisted of 40% silica filler, 30% ER1, and 30% fatty amidoamine resin, trade name "Genamid 490," commercially available from Henkel Corp., Gulph Mills, Pa. The ratio of thermoset binder to nonwoven was about 15:1.

Example 18

The thermoset binder material for Example 18 consisted of 20% calcium carbonate filler, 32% ER1, 32% ECA, and 16% ER2, diluted to 95% solids with SOL. The ratio of thermoset binder to nonwoven was about 14:1.

Example 19

The thermoset binder material for Example 19 consisted of 10% chopped fiberglass (1.5 millimeter in length), commercially available from the Fibre Glast Corp. under the trade designation "Plast #29," 36% ER1, 36% ECA, and 18% ER2, diluted to 95% solids with SOL. The ratio of thermoset binder to nonwoven was about 15:1.

Example 20

The thermoset binder material for Example 20 consisted of 40% silica filler, 15% graphite, 22.5% ER1, and 22.5% fatty amidoamine resin, trade name "Genamid 490," commercially available from Henkel Corp. This example did not contain the third layer of the nonwoven. The ratio of thermoset binder to nonwoven was about 20:1.

Examples 21 through 25

The backing for this set of examples was made according to "Procedure II for Preparing the Backing" and the coated abrasive were made according to the "General Procedure for Making the Coated Abrasive." The nonwoven material was PET1NW. The reinforcing fibrous strand for this set of examples was 1000 denier multifilament polyester yarn, commercially available from Hoechst Celanese under the trade designation "Trevira T-786." For each example a different thermoplastic binder material was employed.

Example 21

The thermoplastic binder material for this Example 21 consisted of 0.11 millimeter thick plasticized PVC film, matte finish, commercially available from the Plastics Film Corp. of America, Lemont, Ill. The reinforcing fiber in the backing was present at a strand spacing of approximately 6 strands/cm. The ratio of thermoplastic binder to nonwoven was about 30:1.

Example 22

The thermoplastic binder material for Example 22 consisted of 0.11 millimeter thick plasticized PVC film, matte finish, commercially available from the Plastics Film Corp. of America. The reinforcing fiber in the backing was present at approximately 6 strands/cm. In this example there was no nonwoven present.

Example 23

The thermoplastic binder material for Example 23 consisted of 0.11 millimeter thick plasticized PVC film, matte finish, commercially available from the Plastics Film Corp. of America. There was no reinforcing fibrous strands present. The backing construction was altered slightly from "Procedure II for Preparing that Backing." The backing was prepared by applying one layer of the thermoplastic binder material, one layer of the nonwoven, followed by a second layer of the thermoplastic binder material, a second layer of a nonwoven and finally a third layer of the thermoplastic binder material. The ratio of thermoplastic binder to nonwoven was about 15:1.

Example 24

The thermoplastic binder material for Example 24 consisted of 0.11 millimeter thick plasticized PVC film, matte finish, commercially available from the Plastics Film Corp. of America. There was no reinforcing fibrous strands present. The backing construction was altered slightly from "Procedure II for Preparing the Backing." The backing was prepared by applying two layers of the thermoplastic binder material, one layer of the nonwoven, followed by a layer of a fiberglass scrim and finally a third layer of the thermoplastic binder material. The fiberglass scrim had 1 yarn/cm in the cross belt direction and 2 yarns/cm in the belt length direction. The fiberglass yarn was 645 yield multifilament E glass, commercially available from Bayex Corp., St. Catherine's, Ontario, Canada. The ratio of thermoplastic binder to nonwoven was about 30:1.

Example 25

The thermoplastic binder material for Example 25 consisted of 0.13 millimeter thick clear polyurethane film, commercially available from the Stevens Elastomeric Corp., Northampton, Mass., under the trade designation "HPR625FS." The reinforcing fibrous strands in the backing were present at approximately 6 strands/cm. The ratio of thermoplastic binder to nonwoven was about 30:1.

Examples 26 through 36

The coated abrasive backings of these examples illustrate various aspects of the invention. The hub to make the backing was the same as the one described in "Procedure I for Preparing the Backing." The coated abrasives were made according to the "General Procedure for Making the Coated Abrasive."

Example 26

A thermoset binder was prepared that consisted of 40% ER1, 40% ECA, and 20% ER2. The thermoset binder was diluted to 95% solids with SOL. The thermoset binder was knife coated (0.076 millimeter thick layer) onto a 0.051 millimeter polyester film purchased from the ICI Film Corp., Wilmington, Del., under the trade designation "Melinex 475." Three layers of this thermoset binder/film composite were wrapped onto the hub with the thermoset binder facing outward from the hub. The thermoset binder was then cured for 30 minutes at 88° C.

Example 27

A fiberglass scrim, as described above in Example 24 was saturated via a knife coater with the thermoset binder of Example 26. The knife coater gap was set to approximately 0.25 millimeter. Two layers of this thermoset/fiberglass scrim composite were wrapped onto the hub. The thermoset binder was then cured for 30 minutes at 88° C. The ratio of thermoset binder to scrim was about 3:1.

Example 28

The backing for Example 28 was made in a similar manner to that of Example 1 except for the following changes. A layer of fiberglass scrim, the same fiberglass scrim as described in Example 24, was inserted between the last layer of the nonwoven and the reinforcing fibrous strands. There was no layer of nonwoven placed on top of the layer of reinforcing fibrous strands. The ratio of thermoset binder to nonwoven was about 13:1.

Example 29

The backing for Example 29 was made in a similar manner to that of Example 1 except for the following changes. There was no reinforcing fibrous strand. There were four layers of the thermoset binder nonwoven composite wrapped around the hub. The ratio of thermoset binder to nonwoven was about 8:1.

Example 30

The backing for Example 30 was made in a similar manner to that of Example 1 except that a layer of an untreated A weight paper was wrapped around the hub prior to the first layer of the thermoset binder/nonwoven. This A weight paper, of mass 70 g/m$^2$, remained a part of the backing.

Example 31

The backing for Example 31 was made in a similar manner to that of Example 1 except for the following changes. The 2.54 cm strip thermoset binder/nonwoven composite was wrapped around the drum twice helically, at an angle of approximately five degrees. A third layer of nonwoven was not used.

Example 32

The backing for Example 32 was made in a similar manner to that of Example 21 except that a 2.54 cm strip of thermoplastic binder/nonwoven were helically wound onto the drum at an angle of approximately five degrees.

Example 33

Backing was made in a similar manner to that of Example 1, except the third layer of nonwoven was not included. A 0.13 millimeter polyurethane film was fused to the outside surface of the backing. Film and method of fusing was same as used in Example 25. The coated abrasive was made according to the "General Procedure for making the Coated Abrasive".

Example 34

Backing was made in a similar manner to that of Example 1, except the third layer of nonwoven was not included. The abrasive was attached to the backing using an acrylate pressure sensitive adhesive (PSA), RD 41-4100-1273-0, available from 3M Company, St. Paul, Minn. PSA coat weight was 1.6 grams (dry weight) per square meter. Abrasive backing laminated to the backing was 3M 211K "Three-M-ite" "Elek-tro-cut," grade 80, commercially available from the 3M Company, St. Paul, Minn.

Example 35

Backing was made in a similar manner to that of Example 1, except the third layer of nonwoven was not included. While the binder was still uncured, a layer of abrasive coat backing was laminated on top of the backing. Abrasive backing laminated to the backing was 3M 211K "Three-M-ite" "Elek-tro-cut," grade 80, commercially available from the 3M Company, St. Paul, Minn. The binder was then cured in the normal fashion.

Example 36

Backing was made in a similar manner to that of Example 1, except the third layer of nonwoven was not included and a different binder resin was used. The binder was a UV curable system made up on 98% "Mhoromer" 6661-0 (diruethane dimethyacylate), commercially available from Rohm Tech Inc., Malden, Mass.; 2% "Irgacurel" 651, commercially available from Ciba-Geigy; Hawthorne, N.Y. After the backing was formed, it was cured under a 300 watts per inch UV light for 20 seconds. The coated abrasive was made according to the "General Procedure for making the Coated Abrasive".

Examples 37 and 38

Two backings were made in a similar manner to that of Example 1, except the third layer of nonwoven was not included and a different binder resin was used. In Example 37, only continuous fiberglass filament yarns were used, whereas in Example 38 two different reinforcing yarns were used side-by-side as the layer of reinforcing yarns. The fiberglass filament yarn was available from Owens-Corning Fiberglass Corp., Toledo, Ohio. The continuous fiberglass filament yarn used was ECG 75 0.7Z 1/0 finish 603, stock number 57B54206, having 30 filaments per inch. The second backing was formed 50/50 side-by-side with one half being the same fiberglass filament as use in Example 37, the second half being made using 1000 denier polyester yarn described in Example 1. The binder resin used was 37.5% urethane resin (known under the trade designation "BL-16" from Uniroyal Chemical Corp.); 12.5% of a solution of 35% methylene diamine/65% 1-methoxy-2-propyl acetate; 16.5% ER1; 16.5% ER2; and 17.0% of GEN. The backings were each coated with a standard calcium carbonate filled resole phenolic make resin, which was partially cured in known manner. Grade 120 ceramic aluminum oxide, commercially available from 3M under the trade designation "Cubitron", was formed into agglomerate abrasive particles in the manner of U.S. Pat. No. 4,799,939 to form agglomerates of average particle size of about 750 micrometers. These agglomerates were drop coated onto the partially cured make coating by conventional techniques. A standard calcium carbonate filled resole phenolic resin size coating was utilized and the resulting structure given a standard cure and flex. Tensile tests were performed as with previous examples, with the results presented in Table 2.

Samples from each backing of Examples 37 and 38 were subjected to bending around sharp edges, and machine direction tensile tests rerun. The following bending cases were used:

Case 1: the backing was folded in on itself until the back sides were touching.

Case 2: the sample was folded around a 0.32 cm diameter rod.

Case 3: the sample was folded around a 0.64 cm diameter rod.

Case 4: the sample was folded around 1.27 cm diameter rod.

The tensile values (kg/cm) in machine direction were as follows:

| | | Case # | | | |
|---|---|---|---|---|---|
| | no flexing | 1 | 2 | 3 | 4 |
| Example 37 | 52 | 7.5 | 30 | 40 | 56 |
| Example 38 | 63 | 58 | 59 | 59 | 57 |

Test Results

Particle Board Test

The Particle Board test results are shown in Table 1. One belt of each type was tested. A sample passed this test if the backing did not break. Only Example 23 "failed," probably because there were no reinforcing yarns in the longitudinal direction. These results indicate that useful abrasive articles can be made from any of the several embodiments of this invention.

TABLE 1

Particle Board Test

| Example | Backing Weight g/m$^2$ | Cut from Workpiece as a % of Control |
|---|---|---|
| 1 | 520 | 103 |
| 2 | 1130 | 83 |
| 3 | 687 | 91 |
| 4 | 775 | 110 |
| 5 | 436 | 70 |
| 6 | 510 | 65 |
| 7 | 581 | 104 |
| 8 | 620 | 67 |
| 9 | 630 | 93 |
| 10 | 525 | 132 |
| 11 | 580 | 104 |
| 12 | 646 | 103 |
| 13 | 533 | 70 |
| 14 | 404 | 111 |
| 15 | 646 | 88 |
| 16 | 600 | 110 |
| 17 | 600 | 101 |
| 18 | 555 | 73 |
| 19 | 606 | 133 |
| 20 | 695 | 129 |
| 21 | 581 | 95 |
| 22 | 543 | 92 |
| 23 | 530 | 14 |
| 24 | 572 | 88 |
| 25 | 569 | 117 |
| 26 | 404 | 87 |
| 27 | 460 | 69 |
| 28 | 631 | 99 |
| 29 | 538 | 96 |
| 30 | 488 | 71 |
| 31 | 541 | 95 |
| 32 | 542 | 101 |
| 33 | 759 | 89 |
| 34 | 743 | 17 |
| 35 | 694 | 42 |
| 36 | 678 | 114 |

Tensile Test Procedure and Results

Strips of dimensions 2.5 cm by 17.8 cm were taken from endless, seamless backings of Examples 1–36. The strips were taken from the backings in two directions: Strips were taken in the machine direction (MD) and from the cross direction (CD) (normal to the machine direction).

These strips were tested for tensile strength using a tensile testing machine known under the trade designation "Sintech", which measured the amount of force required to break the strips. The machine has two jaws. Each end of a strip was placed in a jaw, and the jaws moved in opposite directions until the strips broke. In each test, the length of the strip between the jaws was 12.7 cm and the rate at which the jaws moved apart was 0.5 cm/sec. In addition to the force required to break the strip, the percent stretch of the strip at the break point was determined for both the machine and cross direction samples. "% stretch" is defined as [(final length minus original length)/original length], and this result multiplied by 100. Data are presented in Table 2.

TABLE 2

Tensile Test Results

| | Machine Direction | | Cross Direction | |
|---|---|---|---|---|
| Example Number | Tensile Value (kg/cm) | % Stretch | Tensile Value (kg/cm) | % Stretch |
| 1 | 53.0 | 10.1 | 10.7 | 1.2 |
| 2 | 41 | 3.9 | 8.0 | 1.7 |
| 3 | 34 | 8.5 | 14.6 | 3.0 |
| 4 | 52 | 10.8 | 12.5 | 2.1 |
| 5 | 27 | 10.5 | 11.4 | 2.6 |
| 6 | 63 | 17.2 | 10.0 | 1.6 |
| 7 | 41 | 1.7 | 12.9 | 2.8 |
| 8 | 23 | 8.1 | 14.6 | 3.1 |
| 9 | 22 | 2.2 | 8.4 | 2.1 |
| 10 | 134 | 3.2 | 9.8 | 1.2 |
| 11 | 49 | 10.8 | 8.6 | 12.0 |
| 12 | 63 | 13.0 | 13.4 | 3.1 |
| 13 | 54 | 11.1 | 8.9 | 0.8 |
| 14 | 50 | 9.9 | 11.2 | 1.3 |
| 15 | 45 | 6.0 | 15.0 | 1.3 |
| 16 | 60 | 19.6 | 4.1 | 1.9 |
| 17 | 68 | 19.9 | 8.4 | 1.5 |
| 18 | 58 | 16.3 | 10.7 | 2.2 |
| 19 | 74 | 18.8 | 12.7 | 2.6 |
| 20 | 65 | 18.7 | 8.2 | 0.8 |
| 21 | 48 | 21.2 | 5.9 | 5.1 |
| 22 | 49 | 23.3 | 5.7 | 6.7 |
| 23 | 12 | 27.0 | 8.0 | 14.0 |
| 24 | 29 | 24.2 | 8.6 | 16.0 |
| 25 | 44 | 20.3 | 4.3 | 19.0 |
| 26 | 19 | 5.1 | 21.3 | 15.0 |
| 27 | 28 | 17.0 | 12.0 | 10.4 |
| 28 | 73.6 | 13.4 | 11.6 | 3.2 |
| 29 | 22 | 6.0 | 23.4 | 5.2 |
| 30 | 61 | 21.7 | 13.2 | 2.9 |
| 31 | 59 | 3.2 | 6.9 | 7.4 |
| 32 | 41 | 2.6 | 7.3 | 14.5 |
| 33 | 37 | 14.5 | 5.4 | 18.0 |
| 34 | 38 | 15.0 | 11.6 | 26.0 |
| 35 | 45 | 4.5 | 13.6 | 18.0 |
| 36 | 54.5 | 2.7 | 7.5 | 0.9 |
| 37 | 52 | — | — | — |
| 38 | 62 | — | — | — |

The invention has been described with reference to various specific and preferred embodiments and techniques. It should be understood, however, that many variations and modifications can be made while remaining within the spirit and scope of the invention.

What is claimed is:

1. A method for preparing a coated abrasive belt having an endless, seamless backing; the method comprising:

(a) preparing a loop of liquid organic polymeric binder material having fibrous reinforcing material engulfed therein, in extension around the outer periphery of a support structure;

(b) solidifying the liquid organic polymeric binder material to form a flexible, solidified, endless, seamless loop having about 40–99 wt-% solidified organic polymeric binder material with fibrous reinforcing material engulfed therein, generally parallel side edges, and inner and outer surfaces having generally no fibrous reinforcing material protruding therefrom;

(c) applying a sheet material, coated with abrasive material, to the outer surface of the backing loop; and (d) removing the backing loop from the support structure.

2. The method of claim 1 wherein the abrasive coated sheet material is applied to the outer surface of the backing loop prior to the step of solidifying the liquid organic polymeric binder material.

3. The method of claim 1 wherein the solidified organic polymeric binder material is present in an amount of about 70–85 wt-%.

4. The method of claim 1 wherein the fibrous reinforcing material consists of a plurality of distinct noninterlocking layers of fibrous reinforcing material.

5. The method of claim 1 wherein the step of preparing a loop of liquid organic polymeric binder material, having nonmetallic fibrous reinforcing material engulfed therein, comprises winding one or more nonmetallic fibrous reinforcing strands around the outer periphery of the support structure.

6. The method of claim 5 wherein the one or more fibrous reinforcing strands are coated with the liquid organic polymeric binder material prior to winding around the outer periphery of the support structure.

7. The method of claim 6 wherein the liquid organic polymeric binder material is a thermosetting resin selected from the group consisting of phenolic resins, amino resins, polyester resins, aminoplast resins, urethane resins, melamine-formaldehyde resins, epoxy resins, acrylated isocyanurate resins, urea-formaldehyde resins, isocyanurate resins, acrylated urethane resins, acrylated epoxy resins and mixtures thereof.

8. The method of claim 5 wherein the fibrous reinforcing strands comprise at least two strands, and at least two different compositions of fibrous strands.

9. The method of claim 1 wherein the abrasive-coated sheet material is fastened to the endless, seamless loop using mechanical fastening means.

10. The method of claim 1 where in the abrasive-coated sheet material is fastened to the endless, seamless loop using adhesive fastening means.

11. The method of claim 1 wherein the support structure is a collapsible drum.

12. The method of claim 1 wherein the fibrous reinforcing material is placed in a nonuniform fashion across the width of the backing loop.

13. The method of claim 12 wherein the fibrous reinforcing material is placed only near the center of the backing loop.

14. The method of claim 1 wherein the backing loop has a thickness of about 0.07–1.5 mm.

15. The method of claim 1 wherein prior to the step of preparing a loop of liquid organic polymeric binder material, the method comprises applying a sheet material to the outer periphery of the support structure.

16. The method of claim 15 wherein the stop of preparing a loop of liquid organic polymeric binder material comprises applying a fibrous reinforcing mat structure coated with the liquid organic polymeric binder material around the sheet material on the support structure.

17. The method of claim 16 wherein the step of preparing a loop of liquid organic polymeric binder material comprises winding one continuous fibrous reinforcing strand generally in the form of a helix in longitudinal extension around the length of the backing loop.

18. The method of claim 17 wherein the sheet material is selected from the group consisting of cloth, polymeric film, paper, vulcanized fiber, nonwoven web, and treated versions thereof.

19. The method of claim 1 wherein the fibrous reinforcing material is made of glass, carbon, minerals, synthetic or natural heat resistant organic materials, or ceramic materials.

20. The method of claim 1 wherein step (d) is carried out before step (c).

21. The method of claim 1 wherein step (c) is carried out before step (b).

22. A method for preparing a coated abrasive belt having an endless, seamless backing; the method comprising:

(a) preparing a loop of liquid organic polymeric binder material having fibrous reinforcing material engulfed therein, in extension around the outer periphery of a support structure;

(b) solidifying the liquid organic polymeric binder material to form a flexible, solidified, endless, seamless loop having solidified organic polymeric binder material with fibrous reinforcing material engulfed therein, generally parallel side edges, and inner and outer surfaces having generally no fibrous reinforcing material protruding therefrom; wherein the liquid organic polymeric binder material is a thermosetting resin selected from the group consisting of phenolic resins, amino resins, polyester resins, aminoplast resins, urethane resins, melamine-formaldehyde resins, epoxy resins, acrylated isocyanurate resins, urea-formaldehyde resins, isocyanurate resins, acrylated urethane resins, acrylated epoxy resins and mixtures thereof;

(c) applying a sheet material, coated with abrasive material, to the outer surface of the backing loop; and (d) removing the backing loop from the support structure.

23. The method of claim 22 wherein step (d) is carried out before step (c).

24. The method of claim 22 wherein step (c) is carried out before step (c).

25. A method for preparing a coated abrasive belt having an endless, seamless backing; the method comprising:

(a) preparing a loop of liquid organic polymeric binder material, having fibrous reinforcing material engulfed therein, in extension around the outer periphery of a support structure; wherein:

(i) the fibrous reinforcing material consists of a plurality of distinct noninterlocking layers of fibrous reinforcing material; and (ii) at least one of the distinct noninterlocking layers of fibrous reinforcing material comprises one or more fibrous reinforcing strands wrapped in longitudinal extension around the length of the backing loop;

(b) solidifying the liquid organic binder material to form a flexible, solidified, endless, seamless loop having about 40–99 wt-% solidified organic polymeric binder material with the plurality of distinct noninterlocking layers of fibrous reinforcing material engulfed therein, generally parallel side edges, and inner and outer surfaces having generally no fibrous reinforcing material protruding therefrom;

(c) applying an abrasive coating comprising applying a sheet material, coated with abrasive material, to the outer surface of the backing loop;

(d) removing the backing loop from the support structure.

26. The method of claim 25 wherein the abrasive coated sheet material is applied to the outer surface of the backing loop prior to the step of solidifying the liquid organic polymeric binder material.

27. The method of claim 25 wherein the fibrous reinforcing strands are nonmetallic.

28. The method of claim 25 wherein step (d) is carried out before step (c).

29. The method of claim 25 wherein step (c) is carried out before step (b).

30. A method for preparing a coated abrasive belt having an endless, seamless backing; the method comprising:

(a) preparing a loop of liquid organic polymeric binder material having fibrous reinforcing material engulfed therein, in extension around the outer periphery of a collapsible drum;

(b) solidifying the liquid organic polymeric binder material to form a flexible, solidified, endless, seamless loop having solidified organic polymeric binder material with fibrous reinforcing material engulfed therein, generally parallel side edges, and inner and outer surfaces having generally no fibrous reinforcing material protruding therefrom;

(c) applying a sheet material, coated with abrasive material, to the outer surface of the backing loop; and (d) removing the backing loop from the collapsible drum.

31. The method of claim 30 wherein step (d) is carried out before step (c).

32. The method of claim 30 wherein step (c) is carried out before step (b).

* * * * *

UNITED STATES PATENT AND TRADEMARK OFFICE

CERTIFICATE OF CORRECTION

PATENT NO. : 6,406,577 B1 
DATED : June 18, 2002
INVENTOR(S) : Benedict, Harold W.

It is certified that error appears in the above-identified patent and that said Letters Patent is hereby corrected as shown below:

Title page,
Item [56], U.S. PATENT DOCUMENTS, add -- 5,609,706 3/1997 Benedict et al. --
OTHER PUBLICATIONS, "Witcoband" reference, "©" should read -- ® --.

Column 4,
Line 35, after "not" delete ".".

Column 9,
Line 43, "atcrylated" should read -- acrylated --.

Column 15,
Line 48, "whith" should read -- which --.

Column 16,
Line 66, after "member" delete "-".

Column 17,
Line 48, "spit" should be -- slit --.

Column 21,
Line 14, after "certain" delete "-".

Column 36,
Line 43, "(c)." should read -- (b). --.

Signed and Sealed this

Twenty-fourth Day of June, 2003

JAMES E. ROGAN
*Director of the United States Patent and Trademark Office*